United States Patent [19]

Shimizu et al.

[11] 4,305,654

[45] Dec. 15, 1981

[54] APPARATUS FOR CONTROLLING IMAGE FORMATION

[75] Inventors: Katsuichi Shimizu, Hoya; Hisashi Sakamaki; Katsushi Furuichi, both of Yokohama; Toshio Honma, Tokyo, all of Japan

[73] Assignee: Canon Kabushiki Kaisha, Tokyo, Japan

[21] Appl. No.: 964,023

[22] Filed: Nov. 27, 1978

Related U.S. Application Data

[63] Continuation of Ser. No. 752,895, Dec. 21, 1976, abandoned.

[30] Foreign Application Priority Data

Dec. 27, 1975 [JP] Japan ..... 50-156671
Mar. 31, 1976 [JP] Japan ..... 51-36614

[51] Int. Cl.[3] ..... G03G 15/00
[52] U.S. Cl. ..... 355/14 C; 355/14 R
[58] Field of Search ..... 355/14 C, 14 R, 3 R

[56] References Cited

U.S. PATENT DOCUMENTS

| | | | |
|---|---|---|---|
| 3,813,649 | 5/1974 | Struger et al. | 364/900 |
| 3,917,396 | 11/1975 | Donohue et al. | 355/14 R |
| 3,936,182 | 2/1976 | Sheikh | 355/14 C |
| 4,025,186 | 5/1977 | Hunt et al. | 355/14 R |
| 4,062,061 | 12/1977 | Batchelor et al. | 355/14 C X |

*Primary Examiner*—Fred L. Braun
*Attorney, Agent, or Firm*—Fitzpatrick, Cella, Harper & Scinto

[57] ABSTRACT

A copying or printing machine includes processing units operative for reproducing a copy of an original, a read-only memory having program sequences stored which are composed of coded steps necessary for accomplishing printing or copying cycles, and a random-access memory in which a set of coded signals may be written in and read out. The processing units are actuated in response to coded signals in accordance with the program sequences.

13 Claims, 57 Drawing Figures

| FIG. 1A | FIG. 1B |
|---|---|

| FIG. 2A | FIG. 2B |
|---|---|

FIG. 3-1"

| FIG. 3-1' | FIG. 3-1" |
|---|---|

RANDOM ACCESS MEMORY

READ-ONLY MEMORY

INPUT DEVICE

OUTPUT DEVICE

BASIC TIMING

| |
|---|
| FIG. 9-1' |
| FIG. 9-1'' |
| FIG. 9-1''' |

FIG. 9-1"
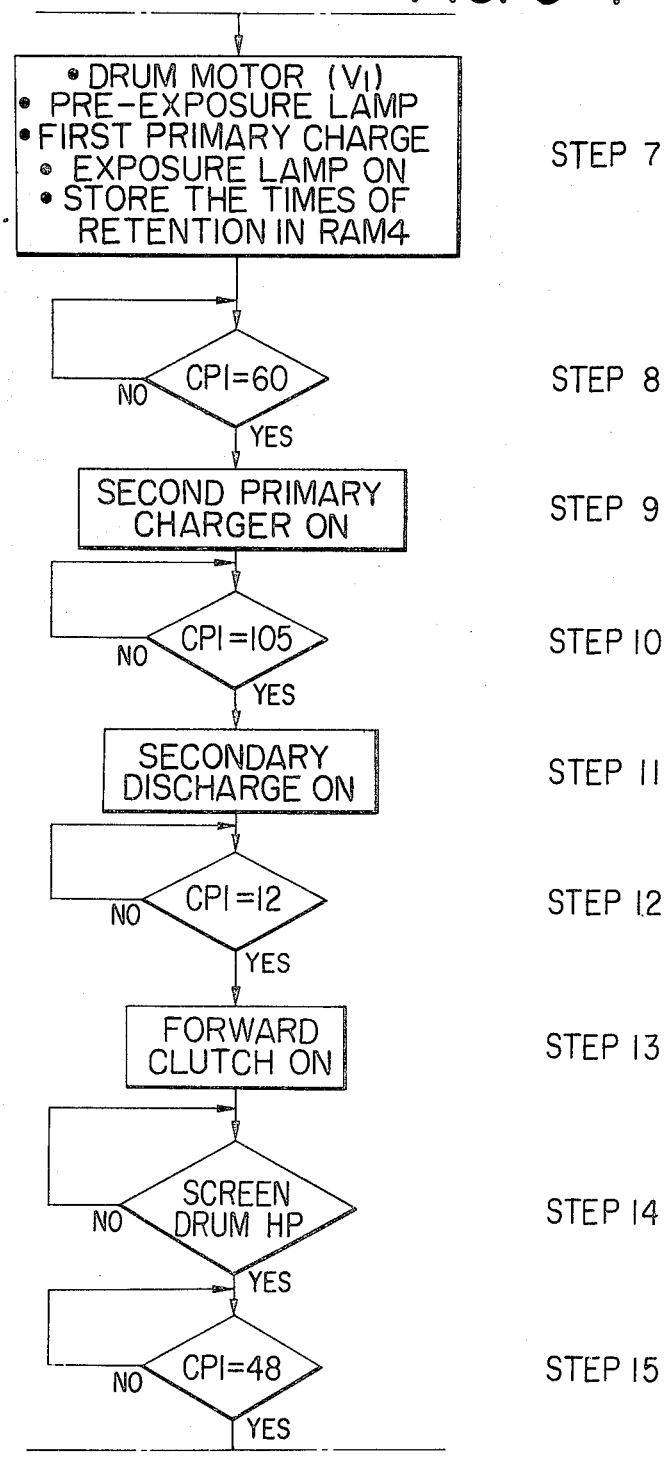

FIG. 9-2"
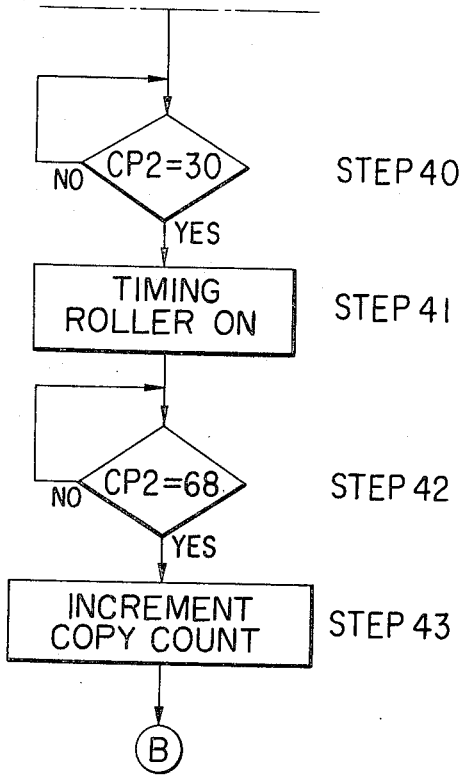
FIG. 9-2
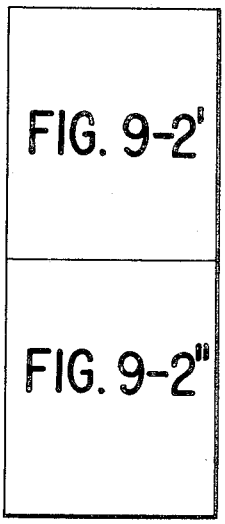

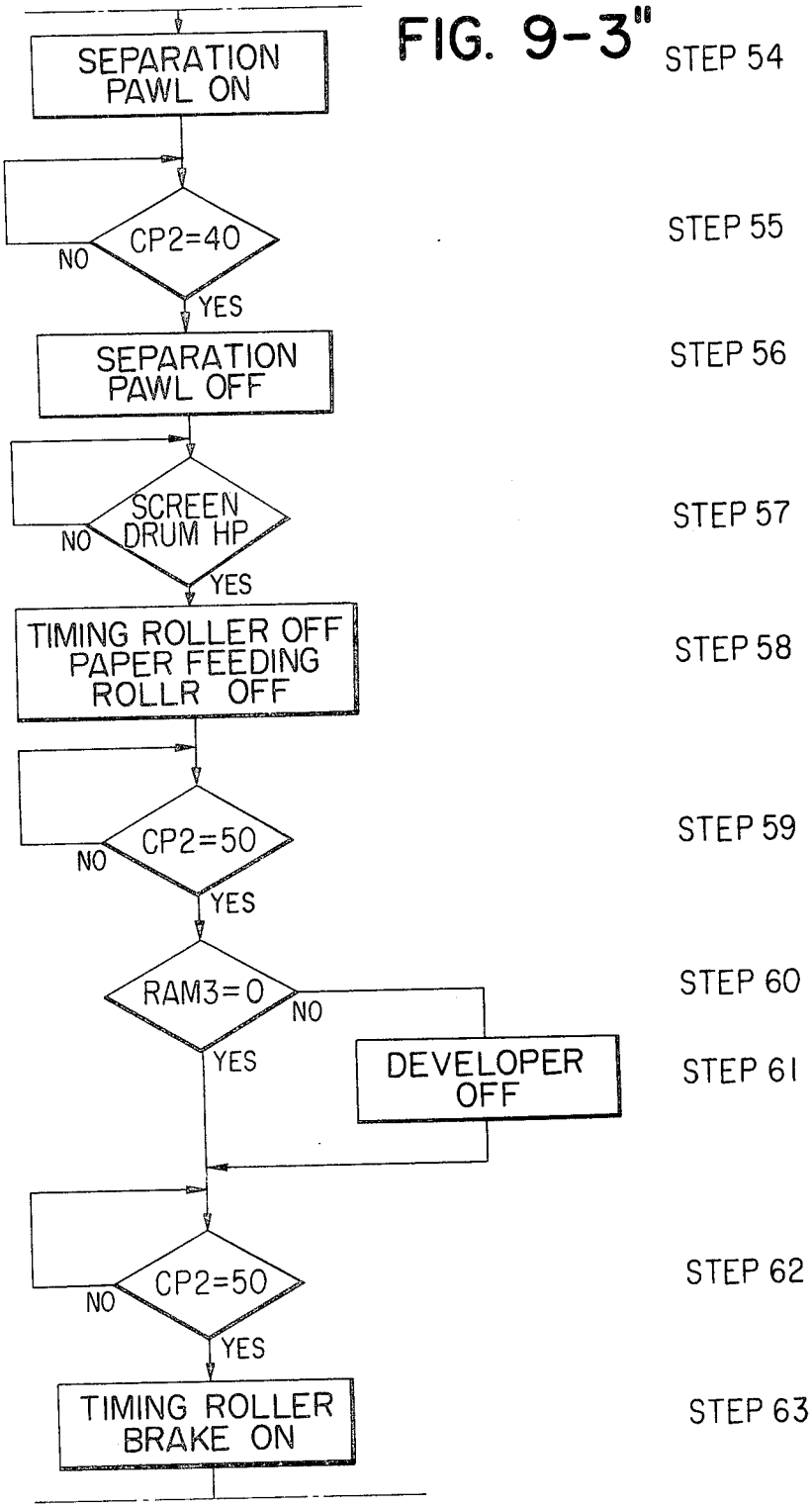
FIG. 9-3"
SEPARATION PAWL ON
STEP 54
CP2=40
NO
YES
STEP 55
SEPARATION PAWL OFF
STEP 56
SCREEN DRUM HP
NO
YES
STEP 57
TIMING ROLLER OFF PAPER FEEDING ROLLR OFF
STEP 58
CP2=50
NO
YES
STEP 59
RAM3=0
NO
YES
STEP 60
DEVELOPER OFF
STEP 61
CP2=50
NO
YES
STEP 62
TIMING ROLLER BRAKE ON
STEP 63

FIG. 15B
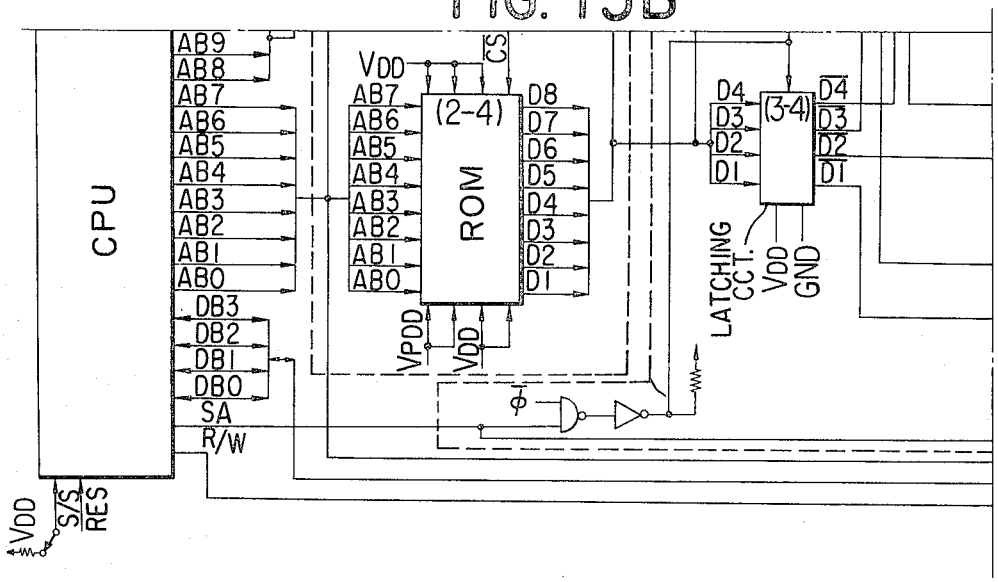
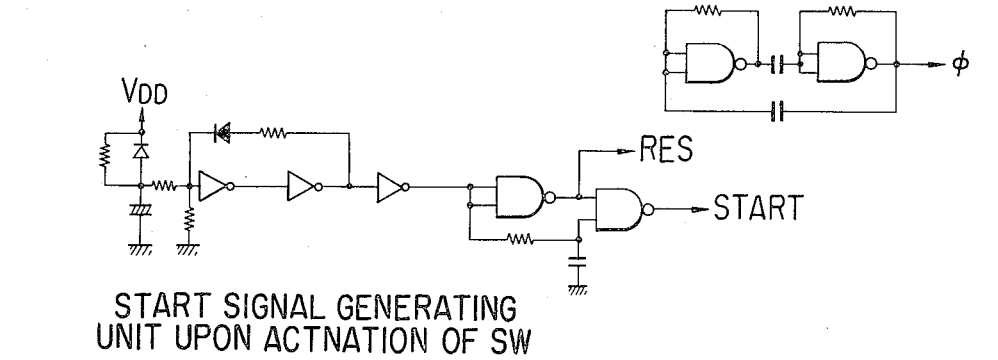
START SIGNAL GENERATING UNIT UPON ACTNATION OF SW
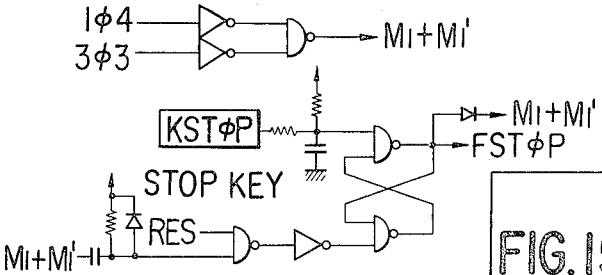
FIG. 15
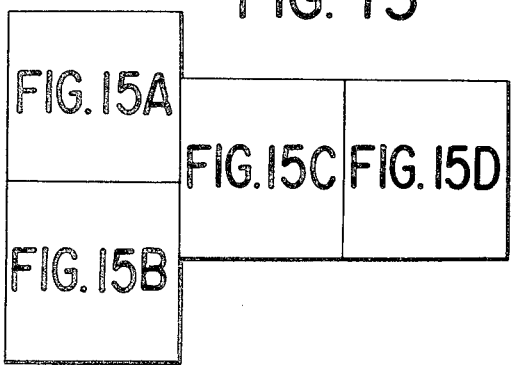

DISPLAY UNIT
Vcc
T0
T1
T2
T3
T4
T5
LIGHT EMITTING DIODES
TRANSISTOR ARRAY
S4 S2 S3 S1 S6 S2 S5 SEGMENT

KEY-BOAD UNIT
KEY
K STOP
KR0
KR1
KR2
KR3
CLEAR MULTI:
SINGLE
T0 T1 T2 T3 T4 T5 T6 T7 T8 T9
0 1 2 3 4 5 6 7 8 9

FIG. 16-3 OUTPUT CIRCUIT
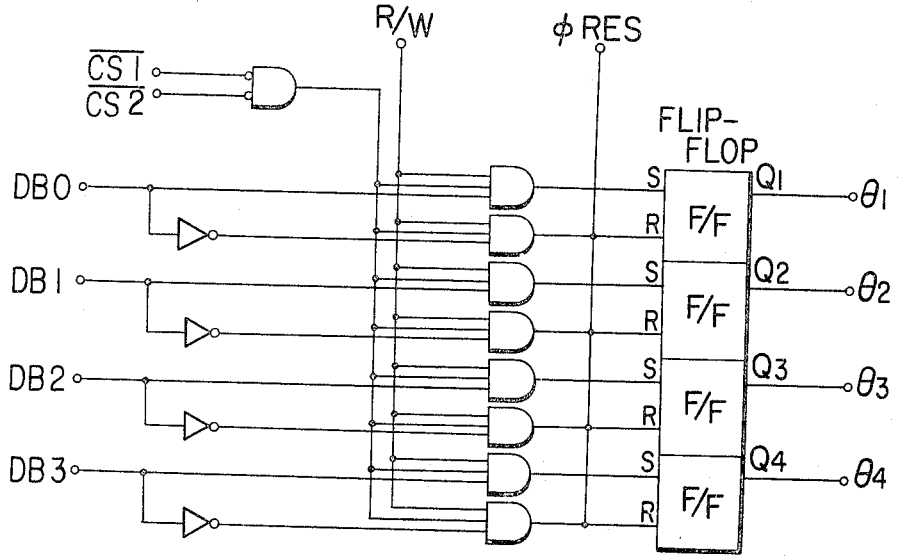
FIG. 16-4 INPUT CIRCUIT
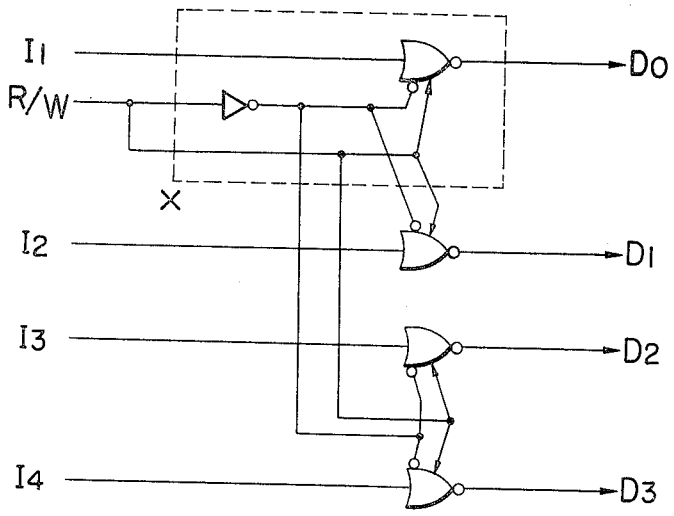
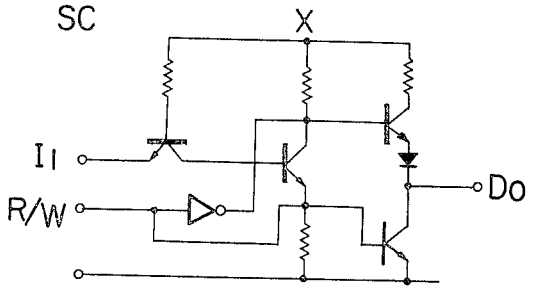

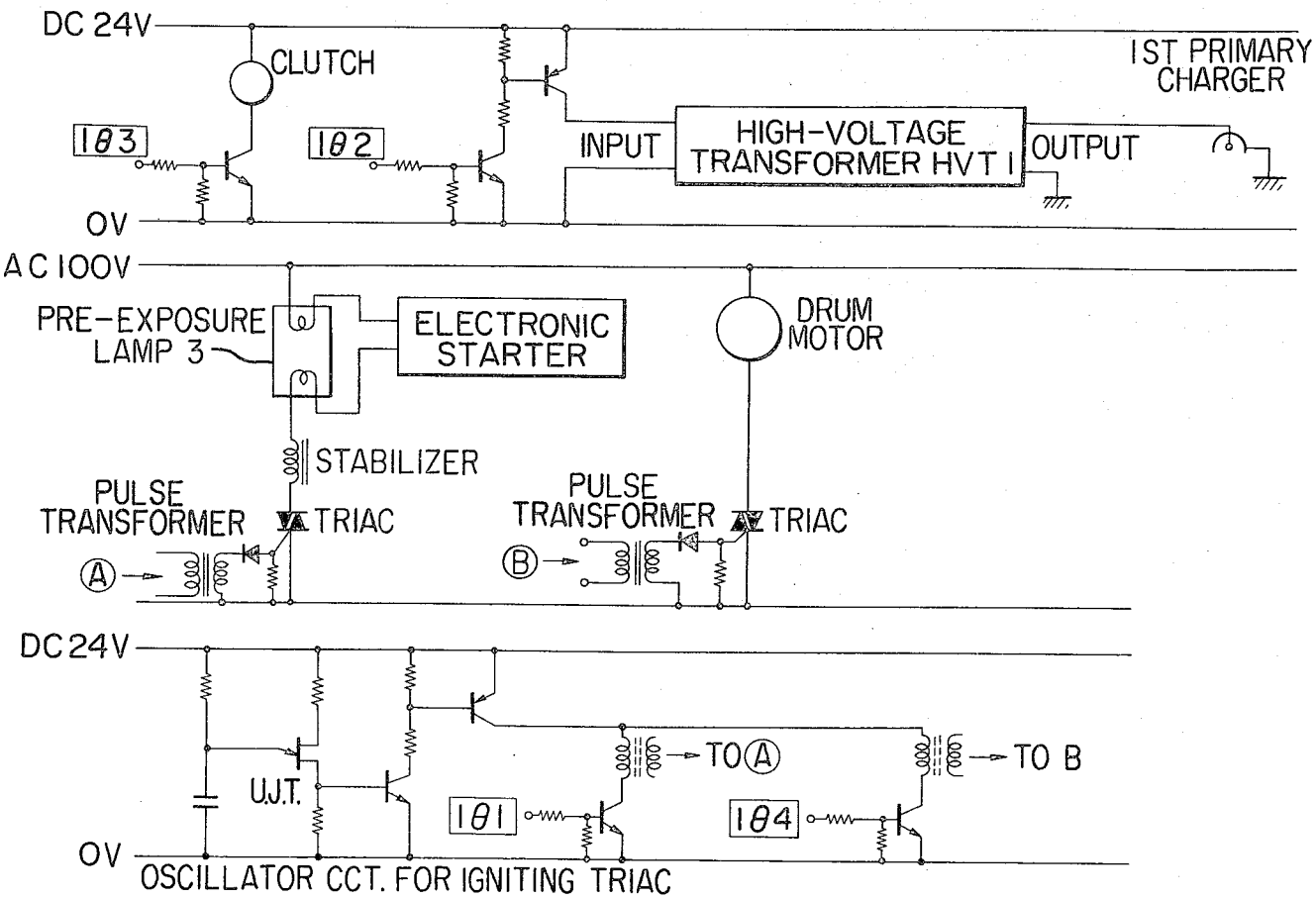
FIG. 16-5 EXAMPLE OF OUTPUT INTERFACE

FIG. 16-6 EXAMPLE OF INPUT CIRCUIT
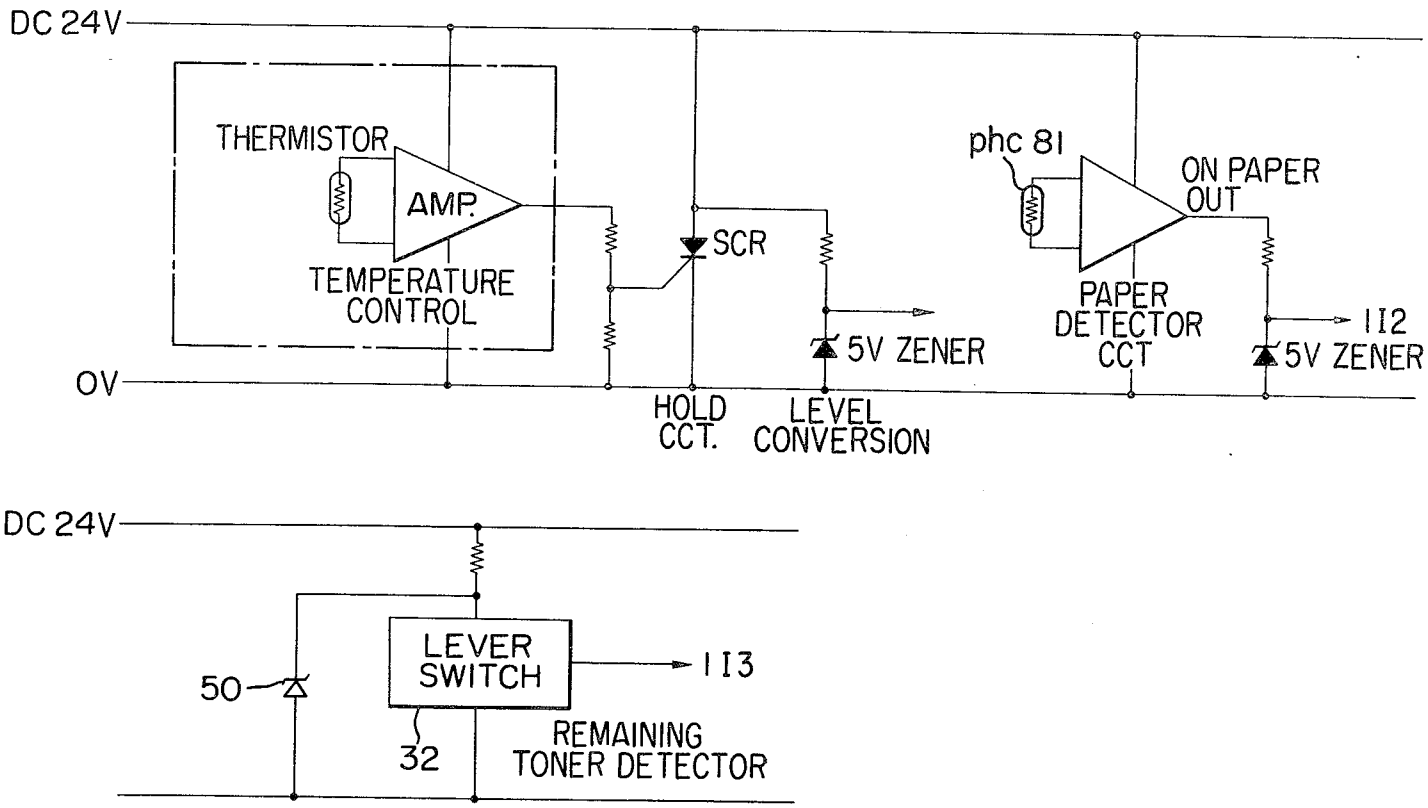

FIG. 17-1"

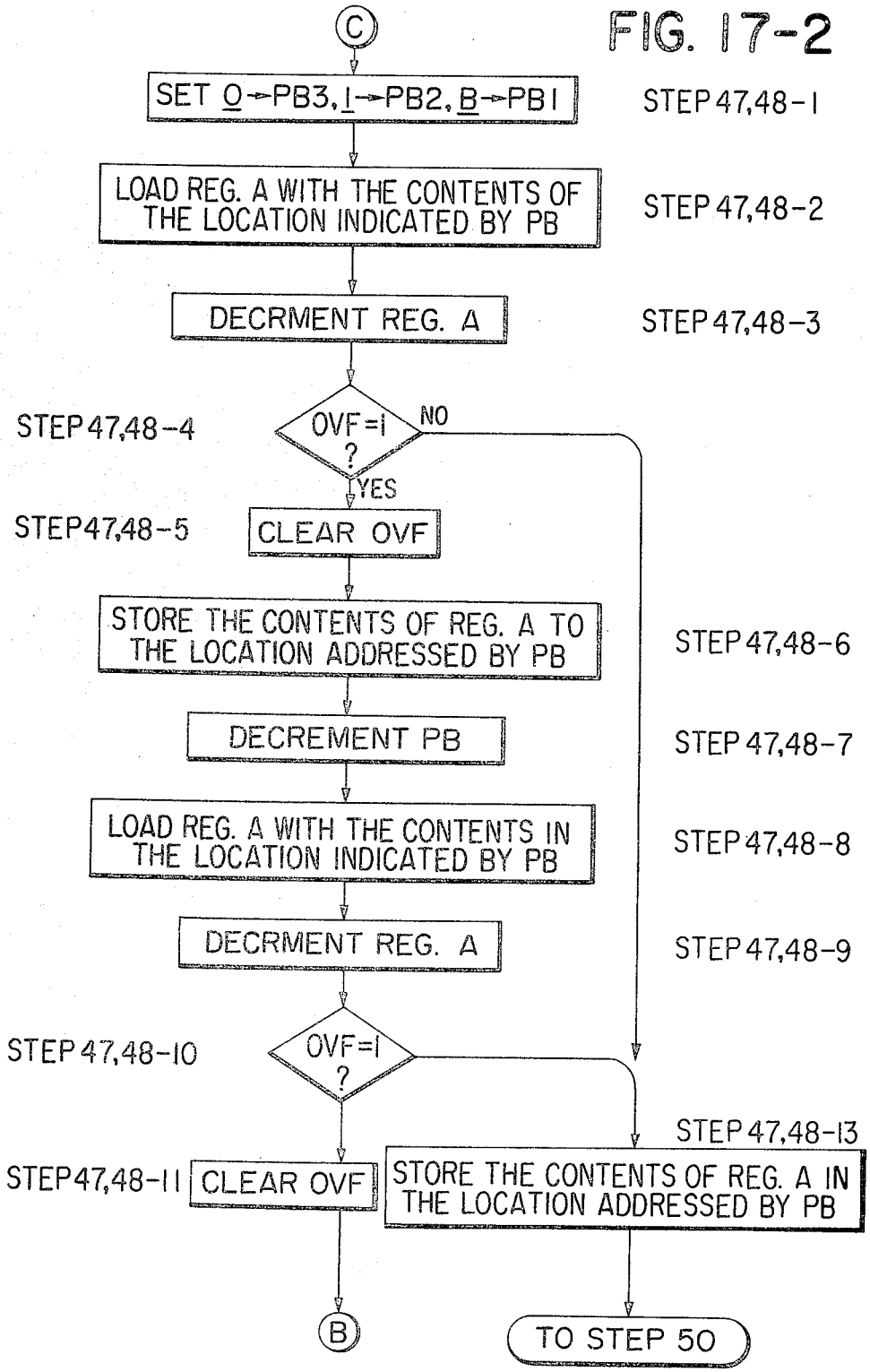
FIG. 17-2
C
SET 0→PB3, 1→PB2, B→PB1
STEP 47,48-1
LOAD REG. A WITH THE CONTENTS OF THE LOCATION INDICATED BY PB
STEP 47,48-2
DECRMENT REG. A
STEP 47,48-3
STEP 47,48-4
OVF=1 ?
NO
YES
STEP 47,48-5
CLEAR OVF
STORE THE CONTENTS OF REG. A TO THE LOCATION ADDRESSED BY PB
STEP 47,48-6
DECREMENT PB
STEP 47,48-7
LOAD REG. A WITH THE CONTENTS IN THE LOCATION INDICATED BY PB
STEP 47,48-8
DECRMENT REG. A
STEP 47,48-9
STEP 47,48-10
OVF=1 ?
STEP 47,48-13
STEP 47,48-11
CLEAR OVF
STORE THE CONTENTS OF REG. A IN THE LOCATION ADDRESSED BY PB
B
TO STEP 50

FIG. 20 CONTROL TIMING
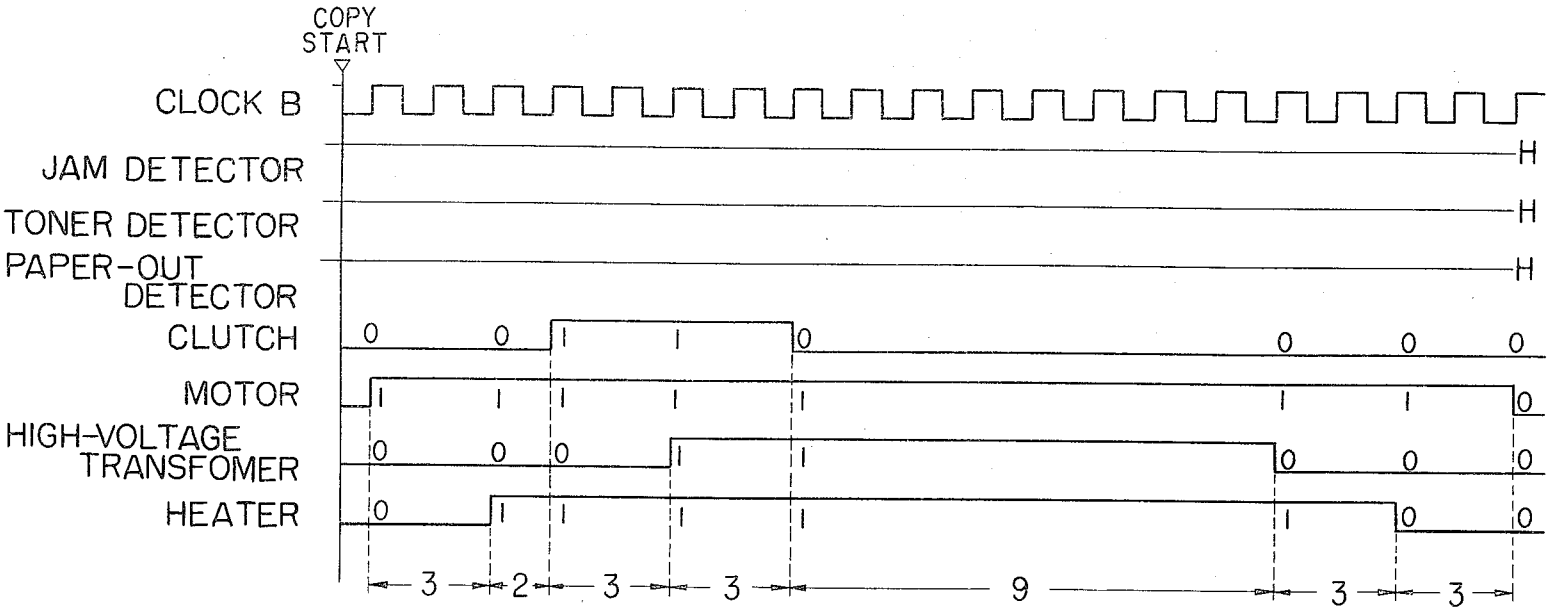

APPARATUS FOR CONTROLLING IMAGE FORMATION

This is a continuation of application Ser. No. 752,895, filed Dec. 21, 1976 now abandoned.

BACKGROUND OF THE INVENTION

1. Field of the Invention

The present invention relates to a copying machine and recording equipment with a computer.

2. Description of the Prior Art

In an electrophotographic copying machine, a photosensitive drum has a photosensitive member consisting of an electrically conductive layer, a photoconductive layer and an insulating layer, the photosensitive member being firmly supported on the peripheral surface of the drum. As the drum is rotated, its surface is uniformly pre-charged (with positive charges, for example) by a primary charger and is scanned with a light image projected from an optical system which in turn is displaced together with or with respect to an original table. Concurrently the scanned surface is discharged by a re-charger with a DC of the polarity opposite to the polarity of the charges imparted by the primary charger. Alternatively, the scanned surface may be discharged with AC. Thus an electrostatic latent image corresponding to the light image may be formed. The latent image is further illuminated or exposed with light so that a high-contrast electrostatic latent image may be formed. Thereafter it is developed into a visible image by a developer with toner. The developed visible image is subjected to a corona discharge with the polarity opposite to the polarity imparted to the toner (for instance, the corona discharge being effected with the negative polarity when the positive pre-charging has been employed) so that the visible image may be more easily transferred onto a copying sheet and then fixed by a heater. After the image transfer, the developing agent mainly consisting of colored particles which remains on the surface of the photosensitive drum is removed and cleaned with a cleaning roller, whereas the remaining charges are removed by a lamp and a corona discharger so that the photosensitive member may be used again. A desired number of copies may be reproduced by cycling the above copying cycle.

In the copying machines of the type described above, a sequential control system has been used for controlling various processing means and especially chargers. In one system used are signals generated by switches which in turn are opened and closed by cams supported on a photosensitive drum. More specifically, upon rotation of the drum, a cam causes a relay to close its terminals, thereby causing the displacement of the original table. When the next cam actuates another relay, a copying sheet feed roller is actuated to feed a copying sheet and so on.

When this cam-and-relay control system is introduced into a retention copying machine or color copying machine, the number of cams and relays is tremendously increased because in this machine processing steps are much greater in number than in the monochrome copying machine. As a result, the control system becomes very complex in construction, the inspection and maintenance becomes very difficult, and the unreliable operation results because of the erratic operations of the switches and relays due to their chattering.

In order to overcome these problems, an electronic digital control system has been introduced in the copying machines so that a sequential control may be attained with logic circuits and arithmetic units. However, the greater the number of steps to be sequentially controlled the greater the number of logic circuits and arithmetic units becomes so that the control system becomes very complex in construction with a very complex wiring arrangement. In addition, these logic circuits and arithmetic units are fixed so that a sequence once set cannot be changed.

Furthermore in the prior art sequentially-controlled copying machines, the sequence is controlled in response to the counting of master clock pulses so that erratic operations tend to occur very frequently due to erratic counting.

SUMMARY OF THE INVENTION

One of the objects of the present invention is therefore to provide a printing or copying machine which may substantially overcome the above and other problems encountered in the prior art copying machines.

Another object of the present invention is to provide a printing or copying machine wherein a timewise programmed sequence of operations to be executed by various processing means alone or in combination is stored in a memory means and the printing or copying operations are sequentially controlled in accordance with this sequence, which may be easily modified as needs demand.

A further object of the present invention is to provide a printing or copying machine where a minimum number of parts including microswitches and leads is used due to the high integration of a control circuit including a computer and input and output circuits.

A further object of the present invention is to provide a printing or copying machine wherein read-only memory means and random access memory means are used to their full and utmost capacity so that any imaginable sequential controls of the copying machine may be accomplished in a very simple manner.

A further object of the present invention is to provide a printing or copying machine wherein erratic operations due to erratic counting of master clock pulses based upon which all operations are carried out, accumulation of errors and deviation in frequency of master clock pulses may be substantially eliminated.

A further object of the present invention is to provide a printing or copying machine wherein in order to prevent erratic operations due to erratic counting of master clock pulses they are started to be counted again from zero everytime when each or a predetermined number of steps have been executed.

A further object of the present invention is to provide a printing or copying machine wherein a computer and memory means are so arranged as to count master clock pulses in response to the variation in level thereof for sequentially controlling the operations or steps.

BRIEF DESCRIPTION OF THE DRAWING

FIGS. 9-1' through 9-1''', 9-2' and 9-2'', and 9-3' through 9-3''', when combined as shown in FIGS. 9-1, 9-2 and 9-3, respectively, show detailed flowcharts of a sequential control;

FIG. 15A through 15D, when combined as shown in FIG. 15, are detailed circuit diagrams of the control circuit shown in FIGS. 3-1', 3-1'' and 3-2 through 3-5;

FIGS. 16-1 through 16-6 show a keyboard circuit, a display circuit and a input-output circuit;

FIGS. 17-1' and 17-1'', when combined as shown in FIG. 17-1, and FIG. 17-2 are detailed flowcharts; starting from STEP 44 to STEP 48 shown in FIG. 9-3' for executing various operations in response to the countup;

FIG. 20 shows a control timing; and

DESCRIPTION OF THE PREFERRED EMBODIMENT

The present invention will be described hereinafter as applied to a retention copying apparatus of the type having a four-bit parallel-processing microcomputer for controlling the sequence of forming a secondary latent image from a primary latent image which in turn has been formed from an original to be copied, developing the secondary latent image with toner and transferring a thus-formed toner image on a copy sheet, thereby providing a predetermined number of the same copies.

Figures 1, 1B:
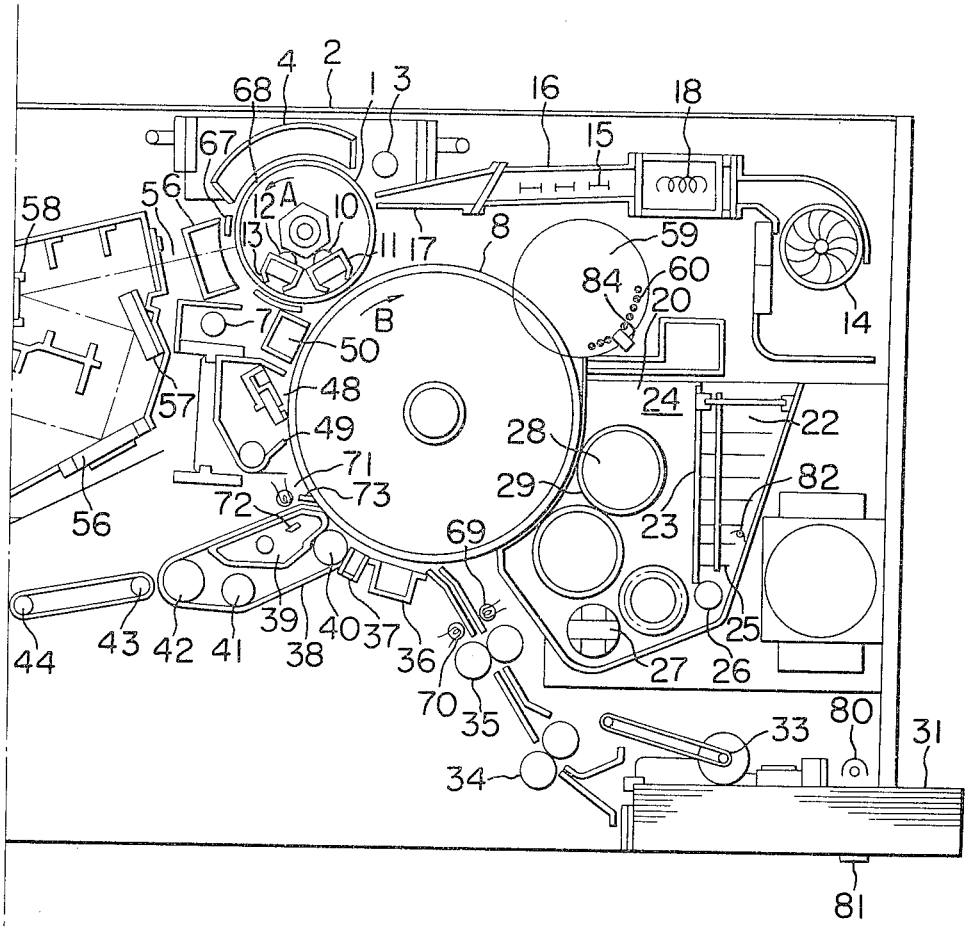
FIGS. 1A and 1B, when combined as shown in FIG. 1, are sectional views of a retention copying machine in accordance with the present invention.
FIGS. 3-1' and 3-1'', when combined as shown in FIG. 3-1, and 3-2 through 3-5 are block diagrams of a control circuit thereof.
Figure 1A:
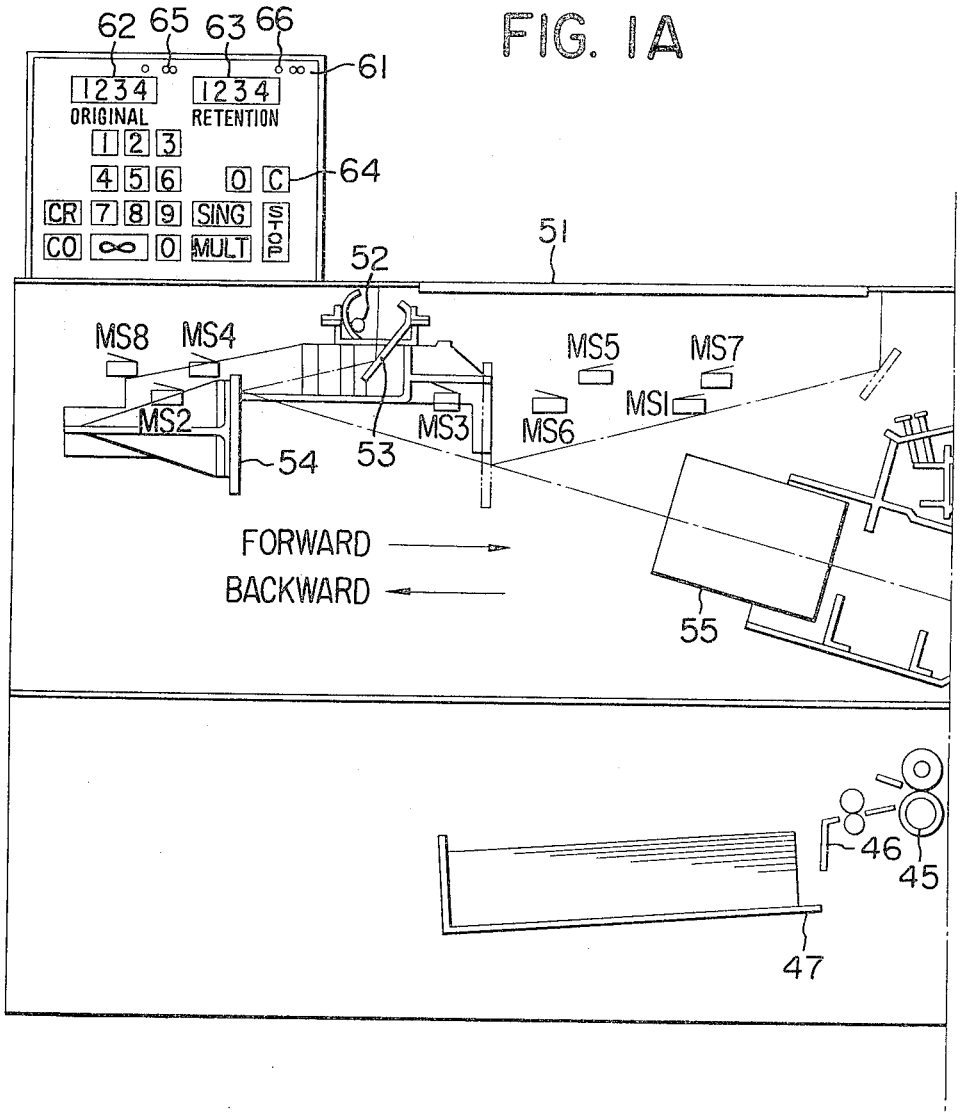
Figures 2, 2B:
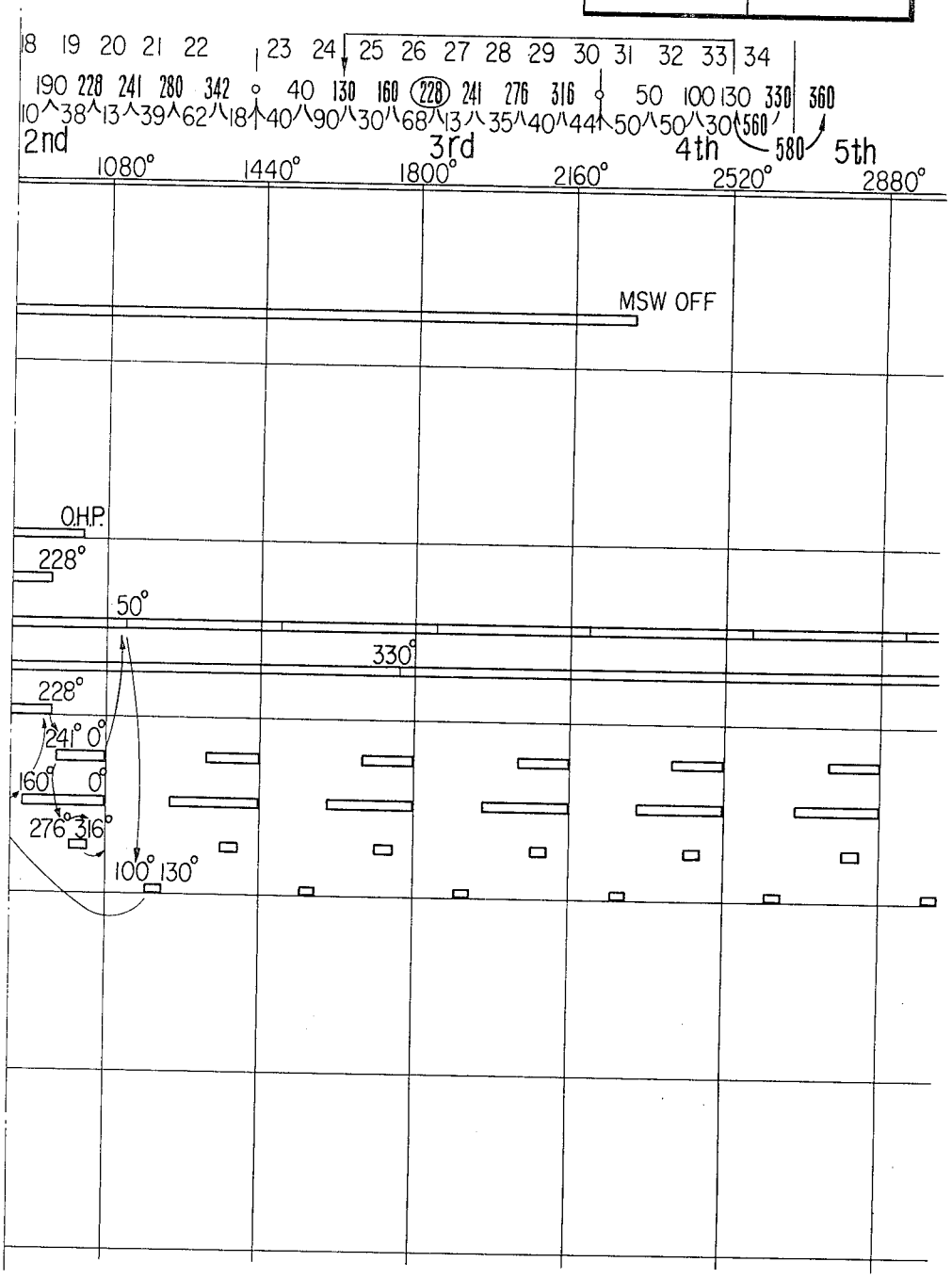
FIGS. 2A and 2B, when combined as shown in FIG. 2 are sequence time charts therefor.

Referring first to FIGS. 1A and 1B and 2, the construction and copying process of a retention copying apparatus to which is applied the present invention will be described. In FIG. 1A and 1B reference numeral 61 denotes a control board; 51, an original table; 52, an exposure lamp, 53, 54, 56, 57 and 58, reflecting mirrors; 55, lens system; 1, a photosensitive drum; 3, a preexposure lamp; 4, a primary charger; 6, a secondary discharger; 7, an illumination lamp; 13, a modulation precharger; 11, a modulation charger; 8, an insulated drum; 24, a developer; 33, a copy sheet feeder; 34, a timing roller; 36, a transfer charger; 73, a separating pawl; 70, 72, paper-out detectors; 45, a fixing roller; 47, a discharge tray; 31, a copy sheet; 14, a blower; and 18, a heater. The photosensitive drum 1 has a mesh-type photosensitive member consisting of a transparent insulating layer, a photoconductive layer and a conducting layer in the order named from the outer surface, the photosensitive drum 1 being described in detail in the specification of Laid Opened Japanese Patent Application No. Sho 50-19455. The primary charger is divided in time and space into two component parts.

Copying operation is carried out in response to commands or instructions which an operator enters on the control board 61 consisting of two displays 62 and 63, two pilot lamps 65 and 66 and a keyboard 64 including the following keys:

Key [O] or ORIGINAL Key:

This is the key for setting a number of electrostatic latent images to be formed on the drum 1. More specifically, an operaor depresses this key first and then enters a desired number of electrostatic latent images to be formed by depressing numeral keys (0)-(9). The present number is being displayed on the display 62.

Key [∞] or Infinity Key:

When this key is depressed, the copying cycle is repeated infinitely and the pilot lamp 65 is turned on.

Key [R] or RENTENTION Key:

This is the key for setting a desired number of copies to be reproduced from one electrostatic latent image. The present number is displayed on the display 63 and the pilot lamp 66 is turned on.

Keys [CO] and [CR]:

These are the keys for correcting the inputs entered by the depression of ORIGINAL and RETENTION Keys.

Key [SING]:

This is the key for obtaining only one copy.

Key [MULT]:

This is the key for obtaining a plurality of copies.

Key [START]:

This is the key for initiating the copy cycle.

Key [STOP]:

This is the key for interrupting the copying operation.

Figure 2A:
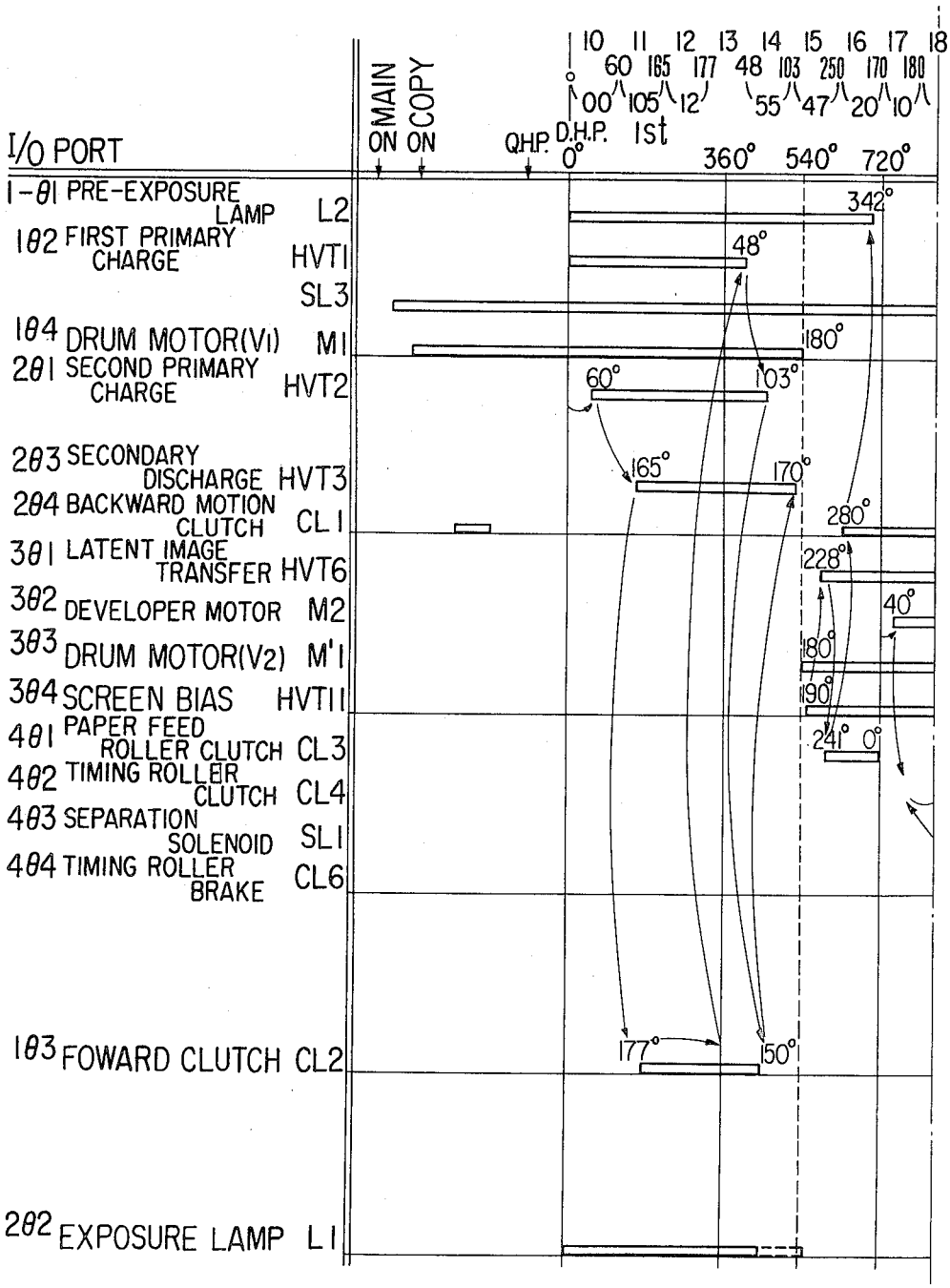

Next referring to the time chart shown in FIGS. 2A and 2B the copying steps will be described. First, a power switch is turned on and then heater 18 and a heater for the fixing roller are energized. A predetermined time after, the copying machine is set ready for copy reproduction. An operator enters ORIGINAL (1) or RETENTION (2) instruction on the control board 61, and then depresses SING or MULT key so that a drum motor M1 is driven. Concurrently, clutches in an optical system are so actuated that the first reflecting mirror 53 together with an original illumination lamp 52 and its reflector is displaced at a speed V1 in synchronism with a peripheral speed of the drum 1 so that the optical system is set in predetermined or home position and an exposure step is started as will be described below. While the original is being illuminated with the illumination lamp 52, the motor M1 rotates at V1 and then is de-energized concurrently when a motor M'1 is energized. Then both drums are immediately driven at a speed V2 almost twice as fast as V1. When the motor M1 is kept energized, the pre-exposure lamp 3 and the illumination lamp 7 are turned on for exposure, and a cooling fan is energized for preventing heat from the illumination lamp 52 from remaining in the optical system. Thereafter the primary charger 4 and the secondary discharger 6 are actuated to form a primary latent image on the screen in the manner described above.

Upon depression of SING or MULT key, a toner image transfer charger 36, a copy sheet separating charger 37, an insulated drum discharger 50 and a copying-sheet-separation function fan are energized and are de-energized after the copying operation has been completed. Since the rotational speed of the insulated drum is slow, the chargers 36 and 37 and the discharger 50 have low potentials so that no excess charge remains on the drum.

Next the screen drum motor is de-energized after a primary latent image has been formed, and the insulated drum motor is energized. Then the steps of modulation, developing, transfer and separation are effected sequentially in the order named. After the modulation step, for the first copy the screen drum makes three rotations and then stops. Thereafter, one copy is reproduced for every one rotation of the screen drum.

Concurrently when the insulated drum motor M'1 is energized, a feed roller clutch is turned on which transmits the force of a cleaning motor to a pre-modulation charger 13 and a belt 38 (See FIG. 1). When the screen drum is rotated through 228° from its home position, the modulation charger 11 is turned on for transferring an electrostatic latent image formed on the screen drum on the insulated drum. Simultaneously, a feed roller clutch CL3 is turned on for feeding one copy sheet upon a feed table at 241°. After the initiation of the modulation step of the screen drum, a second rotation cycle is started, and the feed-roller clutch CL3 is turned off at the home position, and a timing roller clutch CL4 for registering the leading edge of the copying sheet with the leading edge of the toner image developed on the insulated drum is turned on at 160° after a developing motor has rotated through 40°. If only one copy is to be reproduced, the modulation charger 11 is turned off at 228°, but in the present embodiment two copies are to be reproduced so that it is not turned off. At 241°, a feed roller clutch CL3 is turned on for feeding a second copy sheet, and at 360° the timing roller clutch CL4 is turned off. Since a third rotation cycle is initiated, a timing-roller clutch for a first copy is turned off. At 100° the timing roller is applied with brake, and at 160° the timing-roller clutch CL4 is turned on for a second copy sheet. At 228°, the modulation charger 11 is turned off. If only one copy is to be reproduced, the developing motor M2 and a toner-bridge-preventive motor are turned off at 50°. At 360° the timing roller clutch is turned off. When two copies are to be reproduced, the developing motor M2 and the toner-bridging-preventive motor are turned off at 50° in a fourth rotation cycle, and at 33° the insulated drum motor M'1 and the feed-roller clutch are turned off. Thus, two-sheet retention cycle is completed.

A separation-pawl solenoid SL1 is energized between 276° and 316° in a cycle succeeding the second cycle for separating a copying sheet from the insulated drum.

Figures 1, 3:
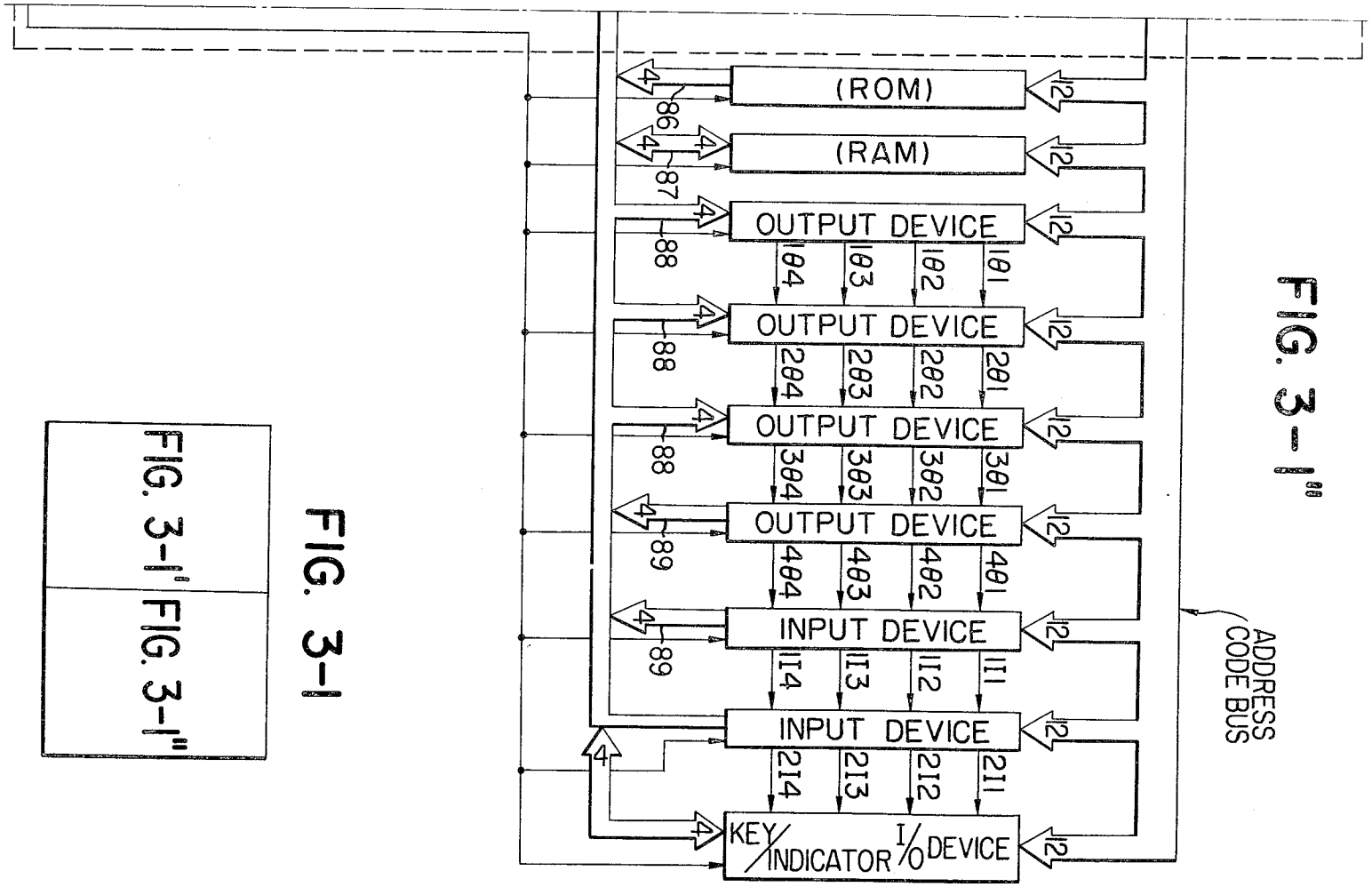
Figure 3:
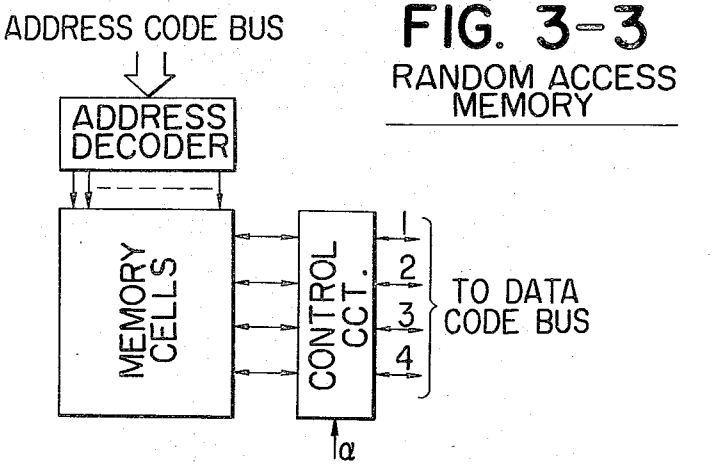
Figures 2, 3:
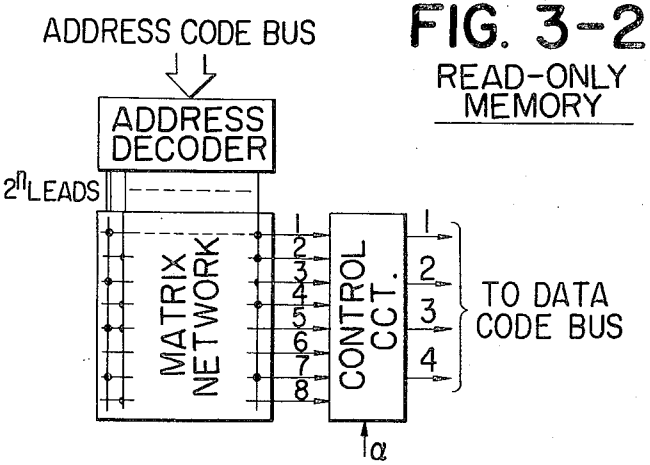

In FIGS. 3-1', 3-1'' and 3-2 through 3-5; there is shown a block diagram of a control circuit for controlling various processing means in the copying machine in order to accomplish the copying process in the sequence described above. A read-only memory ROM, which is shown in detail in FIG. 3-2 and FIGS. 15A and 15B, stores in respective addresses thereof a programmed sequence of operations to be executed by a computer CPU and a programmed output data so that the copying operation may be accomplished in a desired sequence, the data stored in an accessed address being read out and transferred as will be described hereinafter. ROM includes a conventional matrix circuit with a plurality of addresses each storing a binary-coded-eight-bit control instruction (for controlling not only processing means but also other circuits as will be described below).

Figures 3, 4, 5:
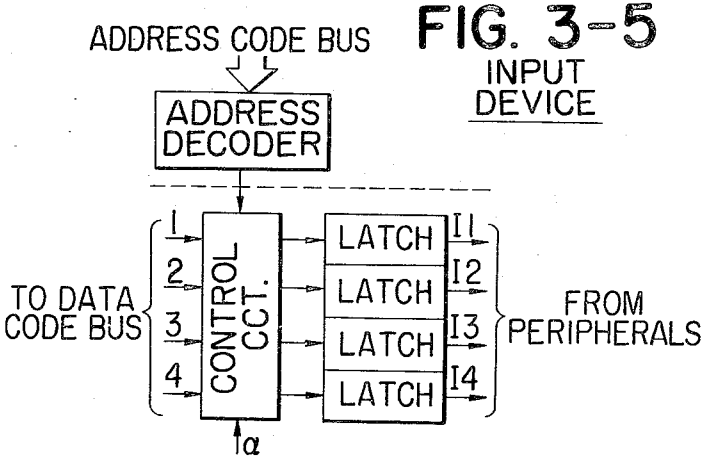
FIGS. 4A and 4, when combined as shown in FIG. 4, show a clock time chart used for the explanation of the access to address in a read-only memory ROM.
FIG. 5 is a circuit diagram of an input-output device.
Figures 3, 4:
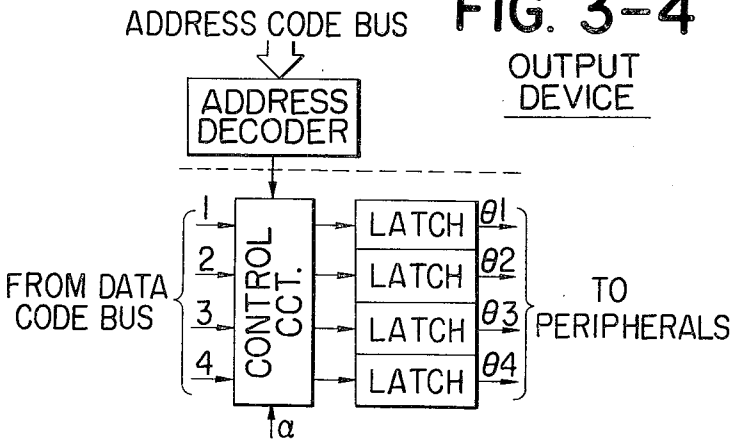
Figures 1, 3:
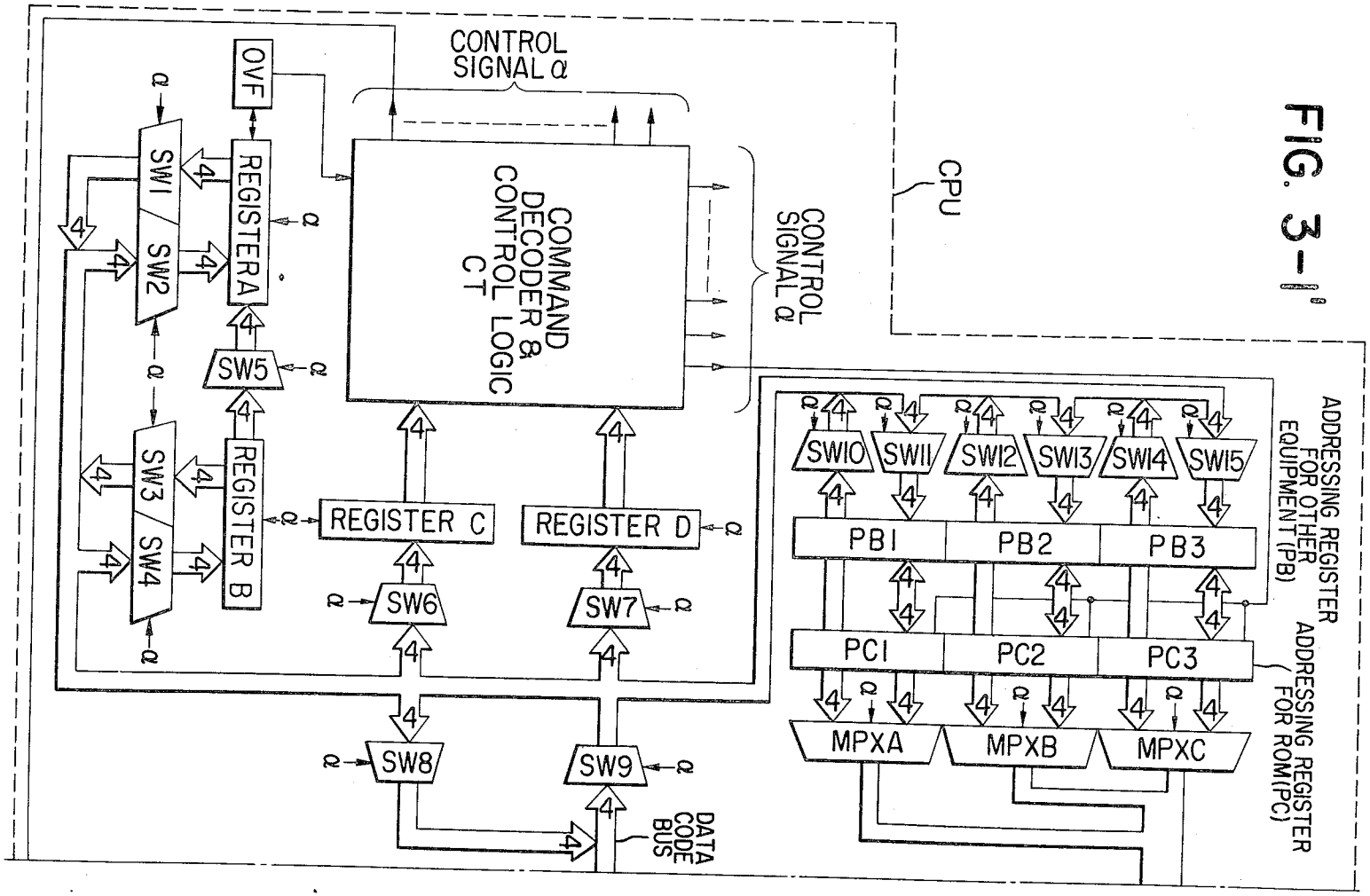
Figure 15A:
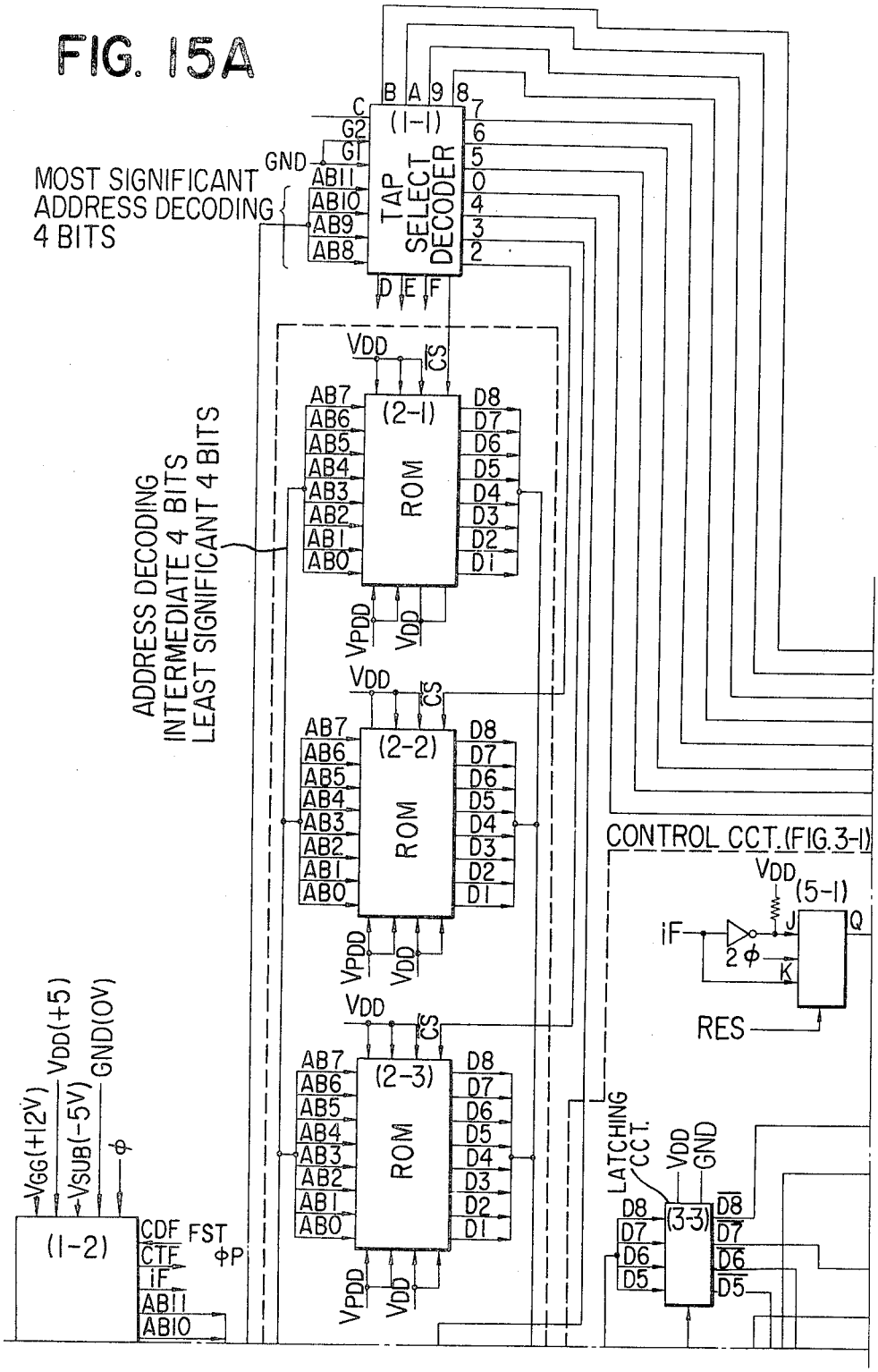
Figure 15C:
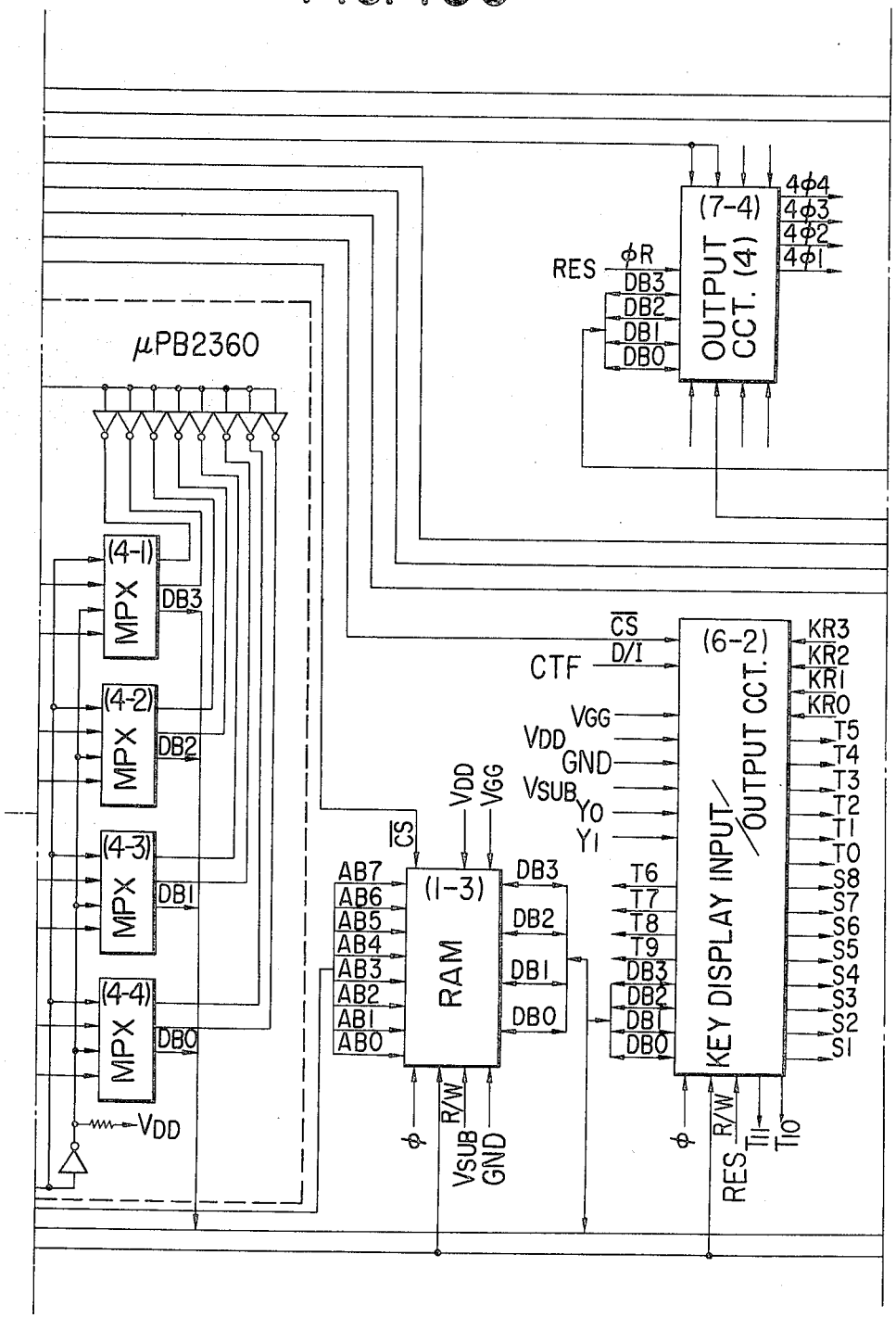
Figure 15D:
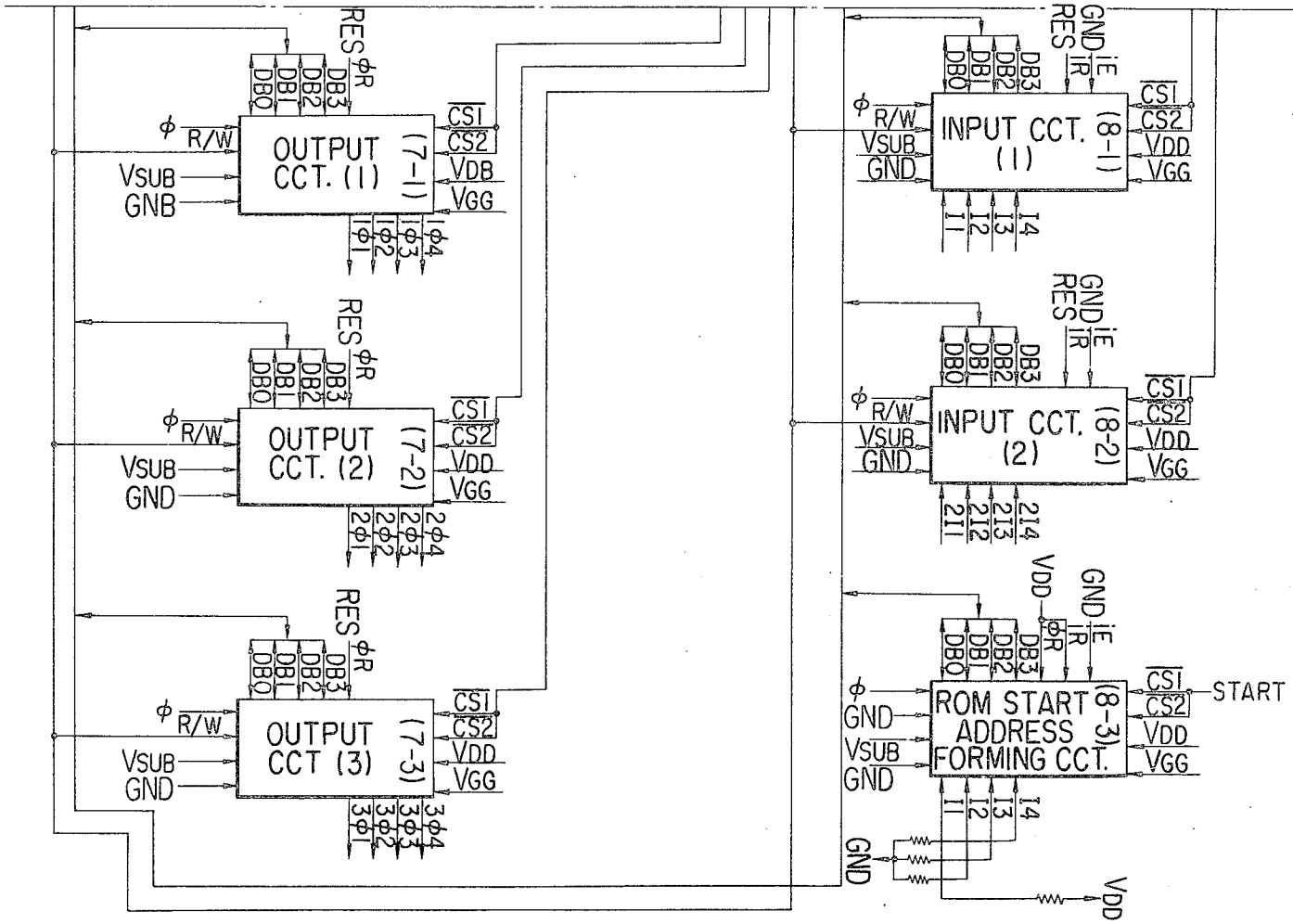
Figure 21:
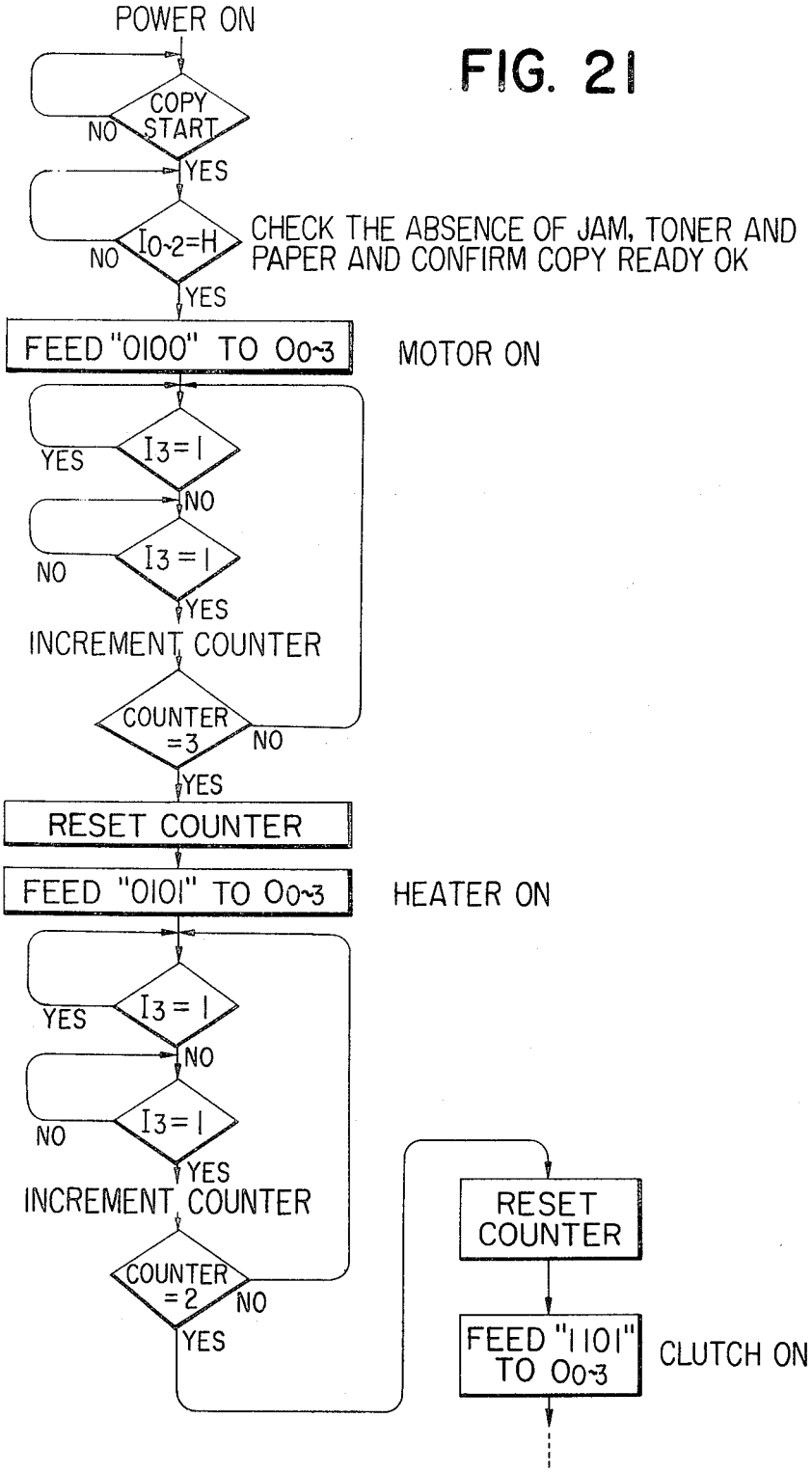
FIG. 21 is a flowchart thereof.

Input devices I-1 and I-2, which are shown in detail in FIG. 3-5 and in more detail in FIG. 15D, store data concerning the copying operation being carried out. Output devices O-1 through O-4, which are shown in detail in FIG. 3-4 and in more detail in FIGS. 15C, 15D and 21, gives control signals for controlling the processing means. A random access memory RAM, which is shown in detail in FIG. 3—3 and in more detail in FIG. 15D, is of the conventional type wherein stored in each address are a set of binary codes representative of a preset, desired number of copies, a number of copies reproduced or stop instruction. RAM consists of a plurality of flip-flop pairs which are specified in response to an addressing signal so that required data may be stored or read out.

The computer CPU is of the conventional type including at least more than two addressing registers PB and PC for access to the above-mentioned memories, input and output devices, at least one storage registers A, B, C and D and a controller or control unit CT having a plurality of logic circuits for decoding and processing data transmitted through a data code bus. To this end, the computer CPU is interconnected with the memories and input and output devices through a plurality of data transmission lines.

Figure 19:
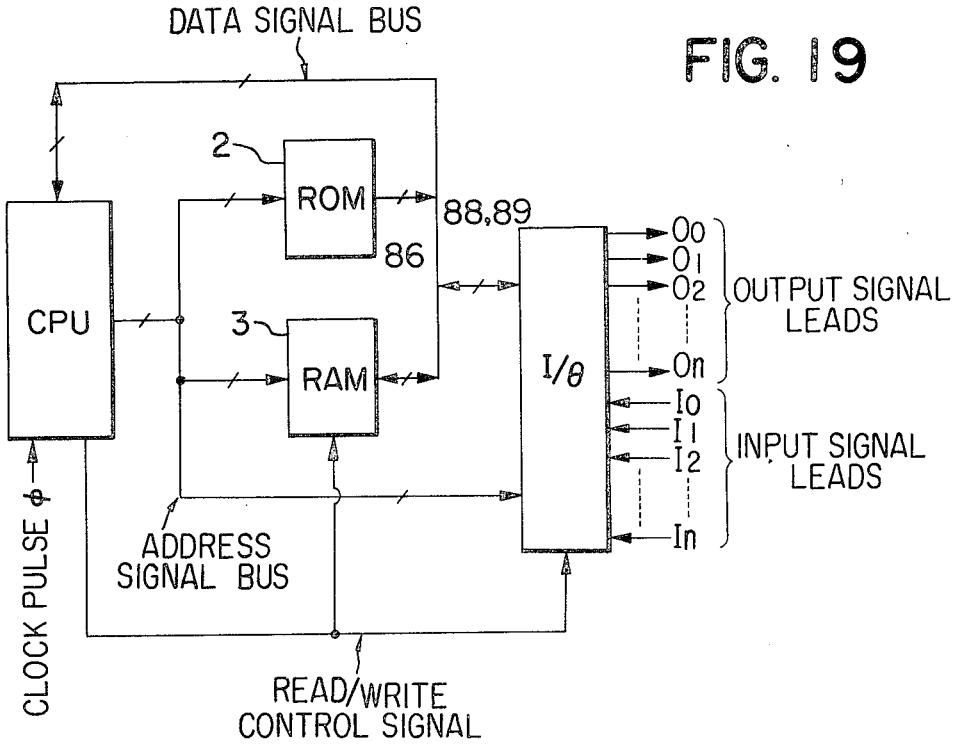
FIG. 19 is a block diagram of a processor.

Next referring particularly to FIG. 19, the mode of operation of the computer CPU will be described briefly. CPU selects an address in ROM and the data stored in this address are transmitted into CPU through a data signal transmission line 86. The data are decoded within CPU when a copying process in a predetermined sequence has already been initiated, the process being started from the first step of turning on the main switch, or the data are stored in a specified address in RAM. Furthermore the data in a specified address in RAM are transferred into the computer CPU or the data are transferred from the computor CPU through an output signal line 88 to the input and output devices or vice versa through an input signal transmission line 89. Thus the copying sequence may be controlled.

More specifically, the whole control system for the copying apparatus may be established by connecting the processing means through input and output signal leads and an interface circuit (see FIGS. 5 and 6) to the input and output device I/O and connecting through input signal leads various detectors for monitoring desired operating conditions of processing means to the input and output device I/O through an interface circuit (which may be eliminated in some cases). The output signal lead Oo is connected through an interface to a clutch or clutches for controlling the reciprocal movement of the optical system; O1, through an interface to the motors for driving the drum and actuating the clutch; O2, through an interface to a high-voltage transformer for effecting corona discharge simultaneous with the exposure step; and O3, through an interface to the fixing heater. The input signal line Io is connected to a jam detector; I1, to a toner detector; I2, a paper-out detector; and I3, a master clock pulse generator for generating master clock pulses B, all through interface circuits. The interfaces however may be eliminated when the outputs transmitted through these input signal lines I have a level acceptable to the input-output device I/O. The clock pulses B have a frequency in proportion to a speed of the photosensitive drum or belt and are used for controlling all sequences of the copying apparatus.

FIG. 20 shows a control timing of the clutch, motor, high-voltage transformer, heaters and so on, and FIG. 21 shows a sequence of operations to be carried out in response to the outputs from the detectors, a high output level=OK and a low output level=Not Good.

In response to START instruction, CPU transfers the contents in Io–I3 of the input-output device I/O into CPU according the programmed sequence stored in ROM or RAM, and determines whether Io–I2 are at high level or not. If they are at low level or Not Good, the operation is suspended until they rise to a high level. When they rise to a high level, I3 or master pulses B rise to H level and a counter in CPU starts counting, the content of the counter being transferred to and stored in RAM. Concurrently, CPU transmits the control signals 0, 1, 0 and 0 on the output signal lines 0o, 01, 02 and 03, respectively, to latch. Then the motor is driven. When the counter in CPU has counted three master pulses B, the control signals on the output-signal leads 0o, 01, 02 and 03 change to 0, 1, 0 and 1, respectively, to latch and turn on the heaters. In this manner, a basic timing chart shown in FIG. 20 is obtained.

Next referring to FIGS. 3-1''; 3-1'', 3-2 through 3-5 and FIGS. 4A and 4B, the basic timing for processing a sequence program will be described in detail. Respective steps of the programme are stored in the form of codes in 8 lines in ROM, and each code is addressed by an address decoder which selects one of **2*n*** lines in response to n codes transmitted through an address code bus. Addresses where instructions are stored in ROM and RCM are addressed by ROM addressing registers PC. Each addressing register PC shifts one position in response to a control signal al so that instructions are successively read out and transferred through multiplexer A, B and C into ROM at a predetermined time.

Since the data code bus 86 consists of 4 lines, an instruction data from ROM which appears on 8 lines must be transmitted in a time division manner in two steps through four lines to the data code bus; that is, four bits being simultaneously transmitted in each step. The instruction codes are latched into the registers C and D through switches SW9, SW6 and SW7 which are opened and closed in response to the control signals $\alpha$ which are generated every two or three clock pulses. The instruction codes are decoded by an instruction decoder to generate the control signal $\alpha$ for controlling the sequence in response to the given instruction. In summary, within four basic pulse cycle, a location where a programme is stored is addressed, and the addressed instruction code is decoded. Within a next six pulse cycle, the decoded instruction is executed. In like manner, the next programme is addressed and decoded and executed. This means that the execution of each step of one programmed sequence requires 10 basic pulses. For instance, the execution of two-word instruction takes 20 clock or basic pulses.

The registers A and B execute arithmetic operations, and each switch SW consists of a gate circuit which is controlled in response to the control signal $\alpha$. An overflow register OVF checks an overflow of the register A. The control unit CT decodes the contents in the registers C and D, executes the arithmetic operation of the contents stored in the registers A and B and generates the control signal $\alpha$ as will be described in detail hereinafter with reference to FIG. 14.

In the input-output device I/O, the following one-to-one correspondence is established:

| | latches or flip-flops | processing means |
|---|---|---|
| Output Device (1) | 1θ1 | pre-exposure lamp |
| | 1θ2 | primary charger, first |
| | 1θ3 | clutch for permitting the going stroke of the optical system |
| | 1θ4 | drum motor (first speed) |
| Output Device (2) | 2θ1 | primary charger, second |
| | 2θ2 | original illumination lamp |
| | 2θ3 | secondary discharger |
| | 2θ4 | clutch for permitting the return stroke of the optical system |
| Output Device (3) | 3θ1 | latent image transfer charger |
| | 3θ2 | developing motor |
| | 3θ3 | drum motor (second speed) |
| | 3θ4 | screen biase charger |
| Output Device (4) | 4θ1 | feed-roller clutch (for copying sheet) |
| | 4θ2 | timing-roller clutch |
| | 4θ3 | copying-sheet separating solenoid |
| | 4θ4 | timing-roller brake |
| Input Device (1) | 1I1 | output from a flip-flop representative of a stop key being depressed |
| | 1I2 | output from paper-out detector |
| | 1I3 | output from toner detector representing the remaining quantity of toner |
| | 1I4 | output from a sensor for detecting the temperature of the fixing heater |
| Input Device (2) | 2I1 | output from a sensor representing the screen drum home position |
| | 2I2 | output from a sensor representing the optical system in home position |
| | 2I3 | clock pulse 1 representative of a first speed of the drum motor, which is 120 mm/sec. |
| | 2I4 | clock pulse 2 representative of a second speed of the drum motor, which is 360 mm/sec. |

Figure 6:
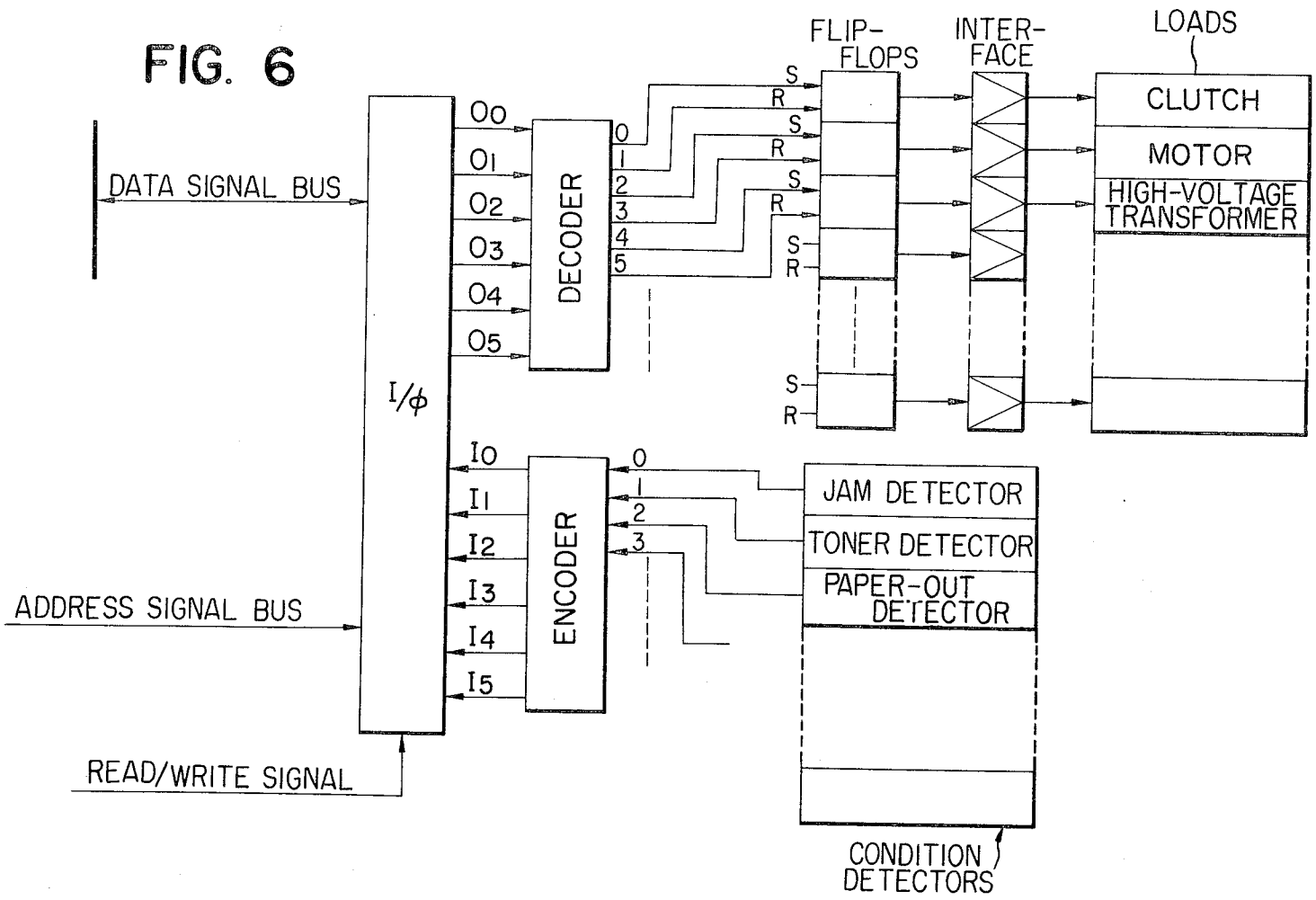
FIG. 6 is another circuit diagram of an input-output device.

The input-output devices I/O are shown in detail in FIGS. 5 and 6, the device shown in FIG. 5 having four-bit output lines whereas the device shown in FIG. 6 having more than four output lines.

The copying apparatus incorporates two oscillators such as astable vibrators, multistable-vibrators or the like for generating one pulse for every rotation of the screen drum through 1°. In the present embodiment, the screen drum has a diameter of 110 mm so that the first clock pulses 1 have a period of about 8 msec whereas the second clock pulses, a period of about 2.66 msec. These clock pulses may be generated by the optical detection (a lamp and photosensitive device 84) through holes 60 of a disk 56 which is rotating at a speed a few times as fast as the insulated drum.

The condition signals; that is, the signals representative of operating conditions of processing means represent "none or NG" when they are at "1" level while they represent "yes or Good" when at "0" level.

Figure 7:
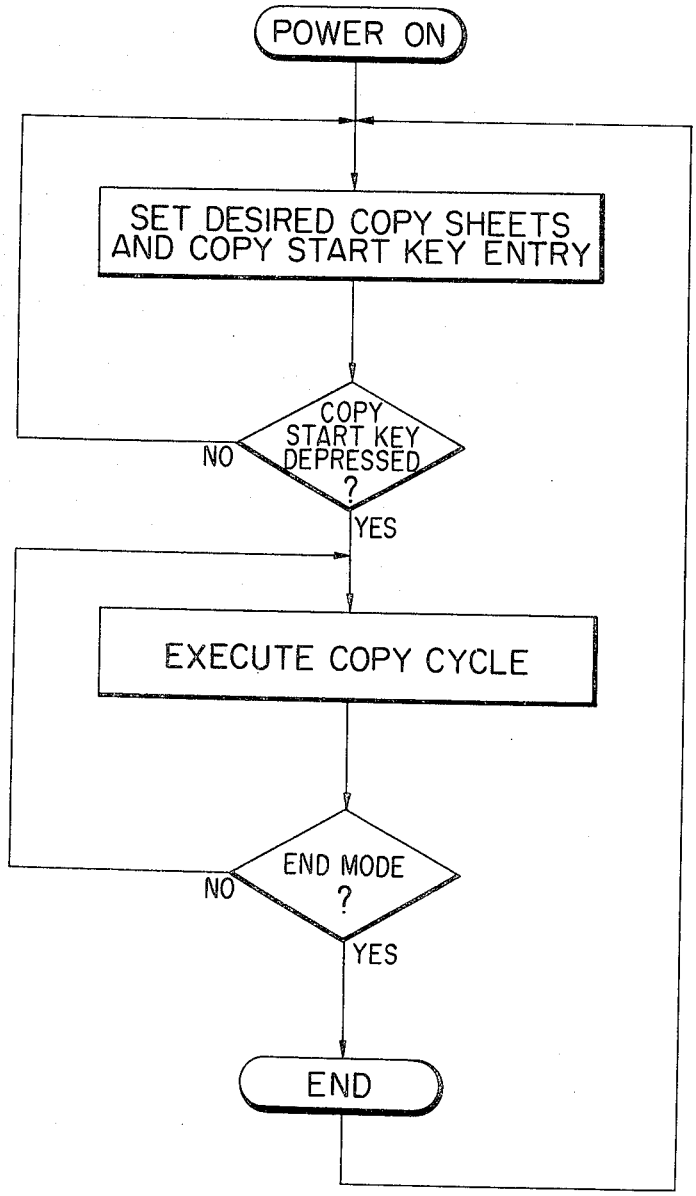
FIG. 7 shows a flowchart of a copying cycle to be executed by the control circuit shown in FIGS. 3-1', 3-1'' and 3-2 through 3-5.

Next referring to a flowchart shown in FIG. 7, the copying sequence will be described. With the power ON or main switch turned on, the copying apparatus is set into a key-entry-ready state. An operator enters a desired number of copies in the manner described previously, and then depresses a START key so that the copying cycle is intiated. Each time when one copying cycle has been accomplished, it is detected whether or not the copying apparatus is in a stop or finish mode (that is, a desired number of copies have already reproduced; toner and/or copying sheet are exhausted). If not set into the stop or finish mode, the copying cycle is repeated, but if set into the stop or finish mode, the copying cycle is interrupted and the copying apparatus is reset to the key-entry-ready mode. The present invention therefore has the feature that since the steps of the copying process are sequentially controlled, the entry of a desired number of copies and the depression of the START key may be prohibited during the copying cycle and the copying cycle will not be initiated until a required key entry has been completed.

Figure 8:
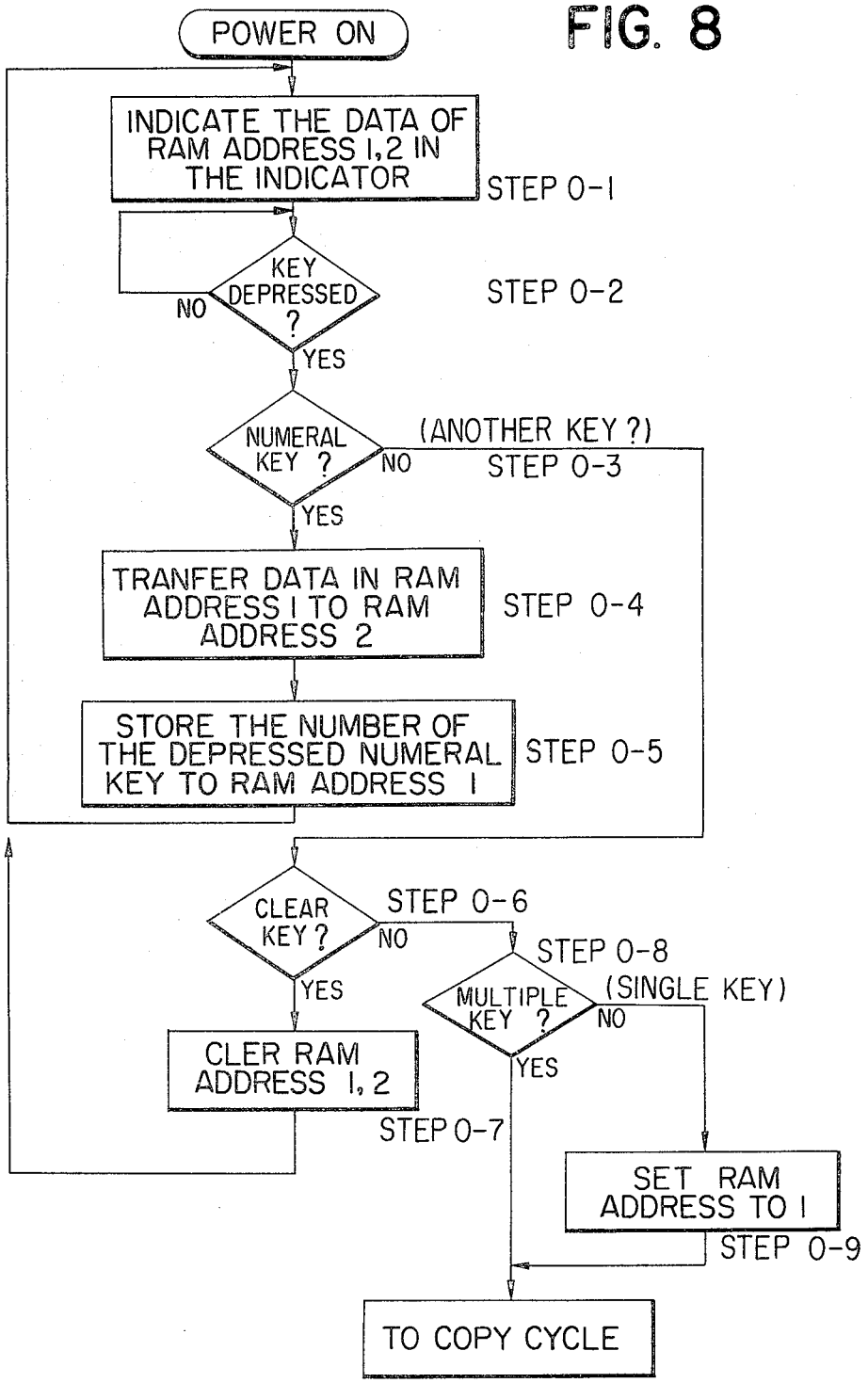
FIG. 8 shows a key entry flowchart associated with one shown in FIG. 7.

Key Entry Cycle:

As described previously, key entry is made with the numeral keys from 0 to 9 for setting a desired number of copies, the MULT key for starting the copying operation or SING key for obtaining only one copy, the STOP key for stopping the copying operation and CLEAR key for clearing erroneously entered data as will be described in detail with particular reference to FIG. 8.

With the numeral keys, an operator can set any number of two digits of copies; that is, up to 99. The first digit is stored in RAM location 1, and the second digit, in location 2. In STEP 0-1 after the power has been turned on, data stored in RAM locations 1 and 2 are displayed on the display and STEP 0-2 is a decision box to check whether a key is depressed or not. STEP 0-3 is also a decision box to check whether or not the depressed key is a numeral key and if so STEP 0-4 and STEP 0-5 are executed so that the entered integer is stored in RAM location 1 and the control loops back to STEP 0-1. The stored integer is displayed. If in STEP 0-3 a key other than the numeral keys is depressed, the control advances to STEP 0-6. When CLEAR key is depressed, RAM is cleared in STEP 0-7 and the control loops back to STEP 0-1, the display device displaying "00". If MULT key is depressed, the control advances to the copying cycle. If SING key is depressed, the integer "1" is stored in RAM location 3 in STEP 0-9 and the control advances to the copying cycle. That is, the information stored in the location 3 decides the finish mode or not. More specifically, when "0" is stored in location 3, the control advances to the copying cycle, whereas if "1" is stored, the control advances to the finish or halt mode. This decision is made everytime when one copying cycle has been completed (see also FIGS. 9-1' through 9-3''').

Figures 1, 9:
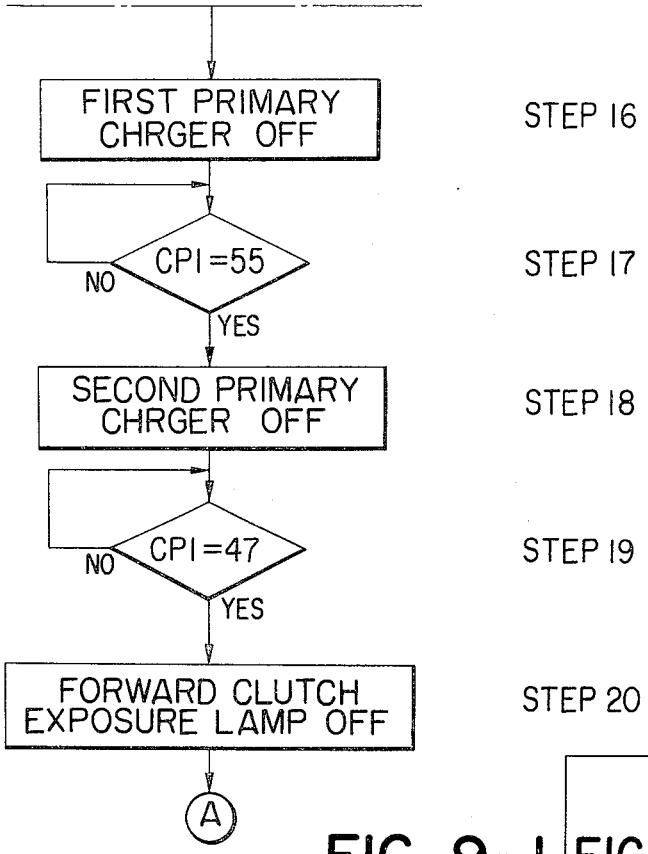
Figures 1, 9:
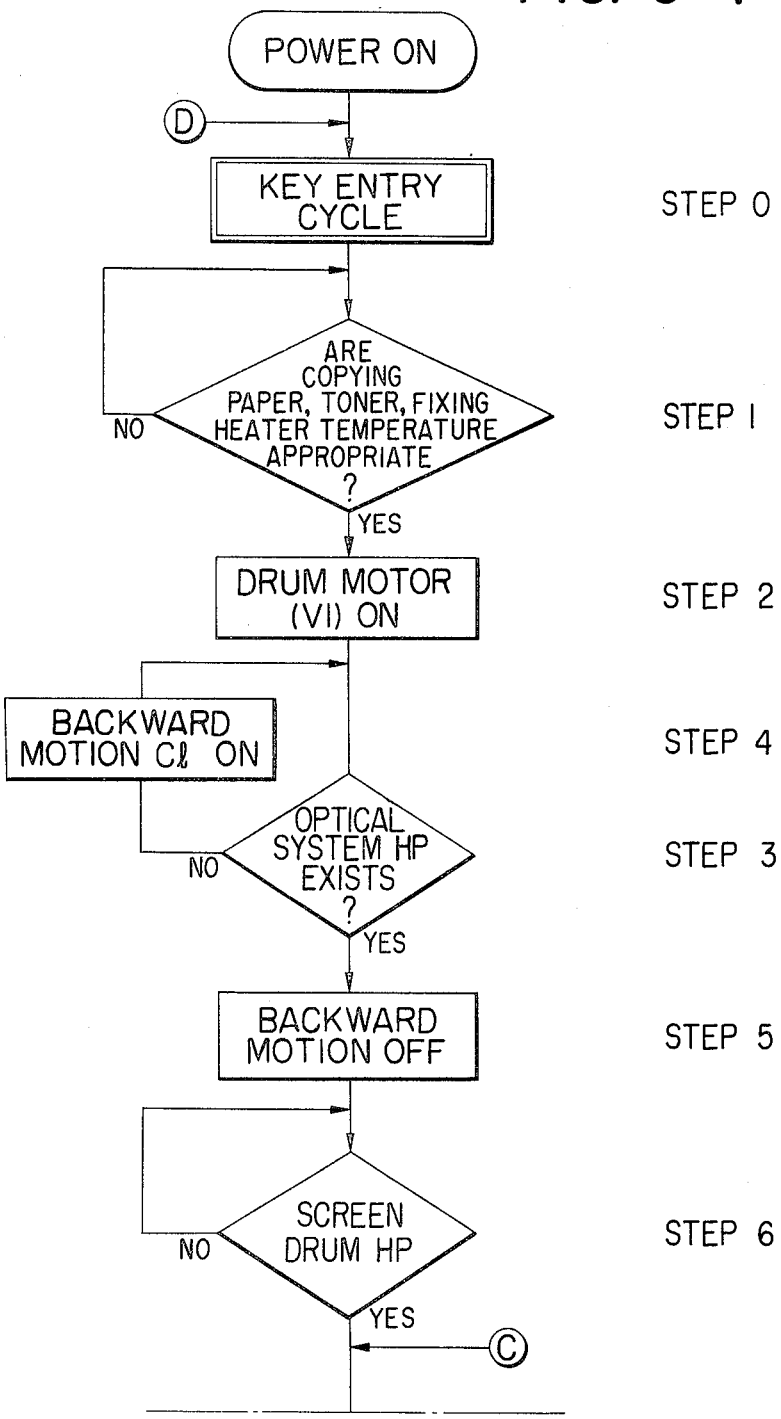
Figures 2, 9:
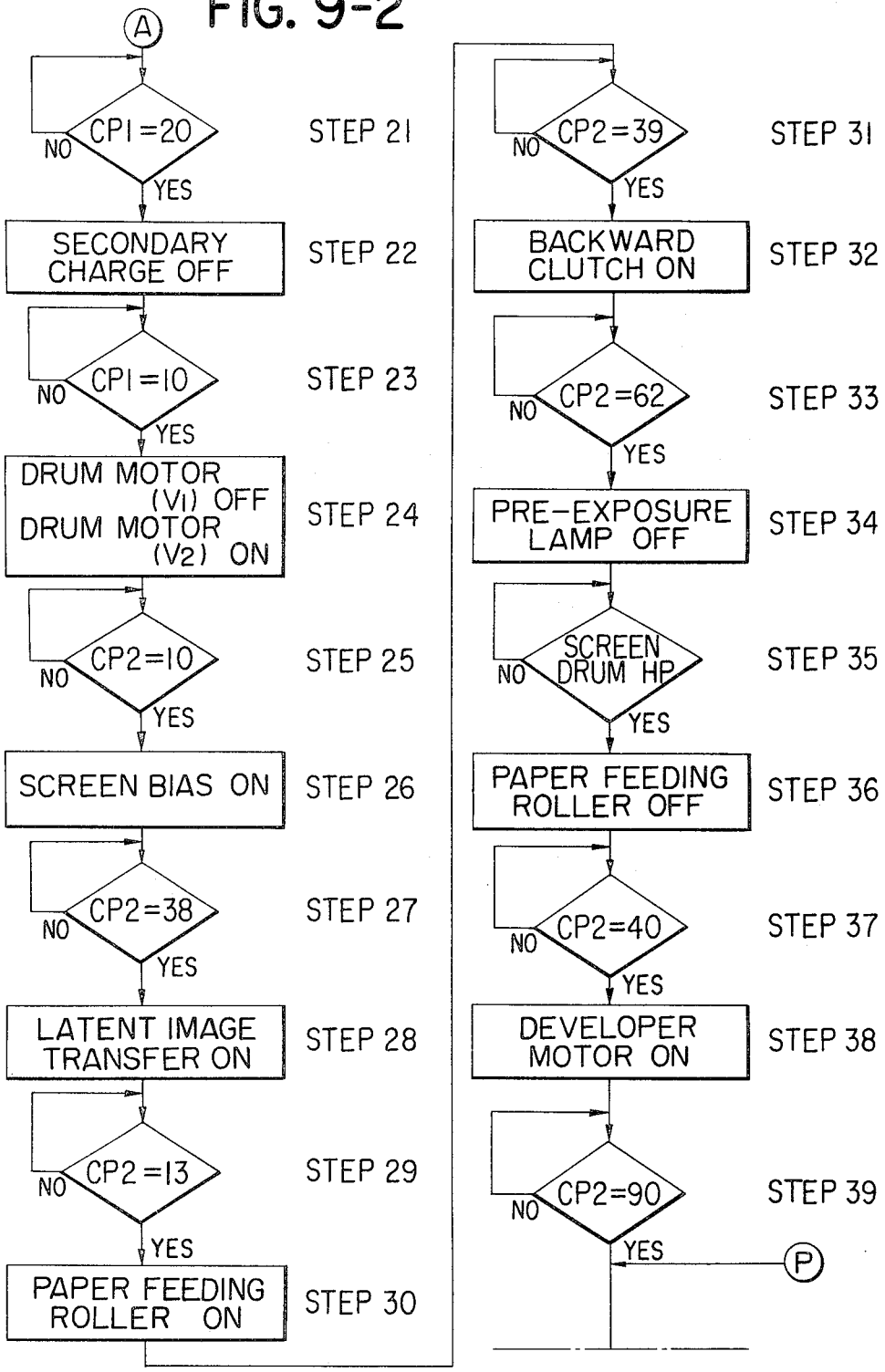
Figures 3, 9:
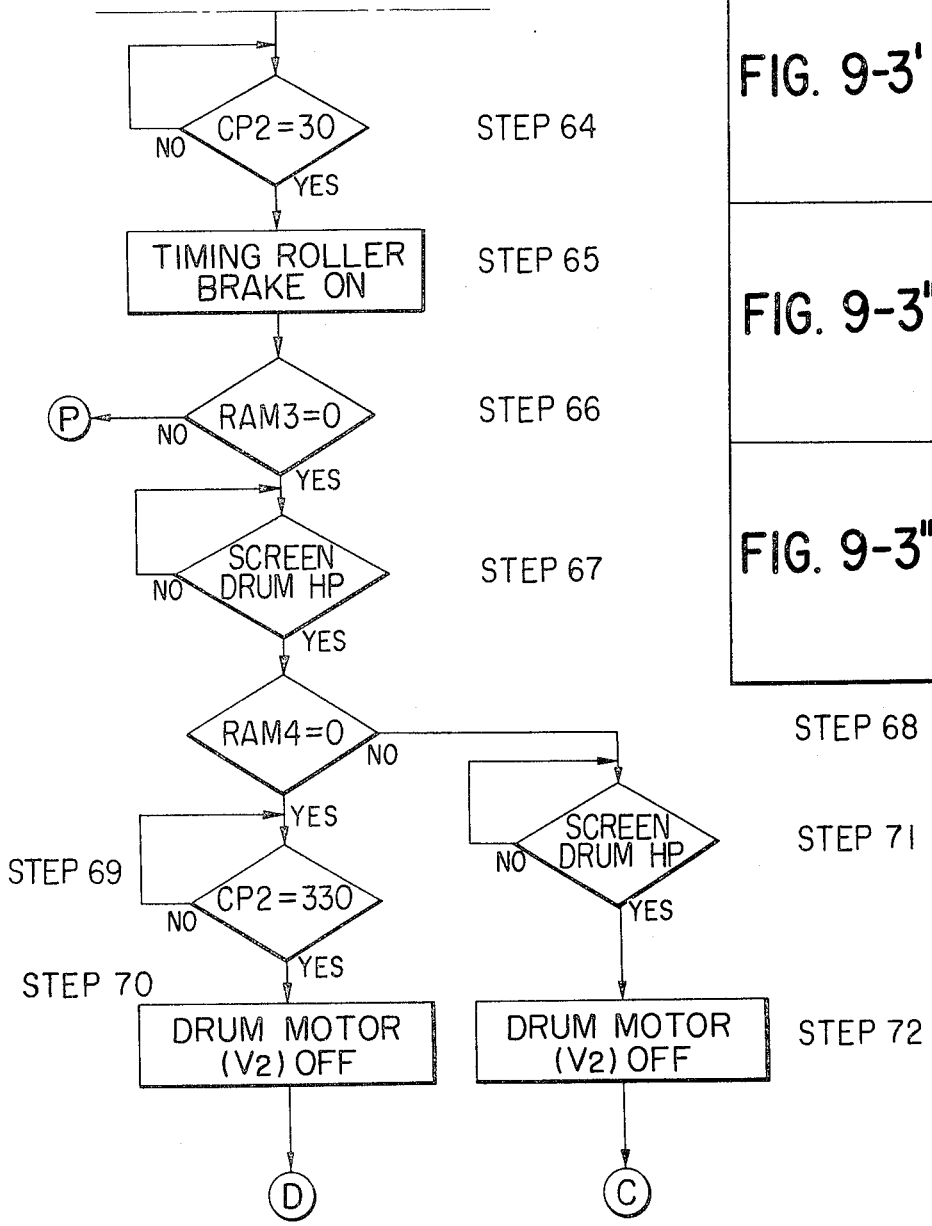
Figures 3, 9:
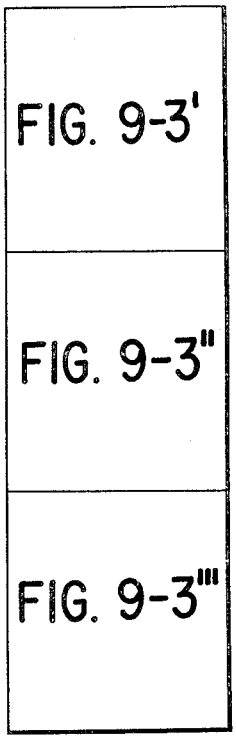
Figures 3, 9:
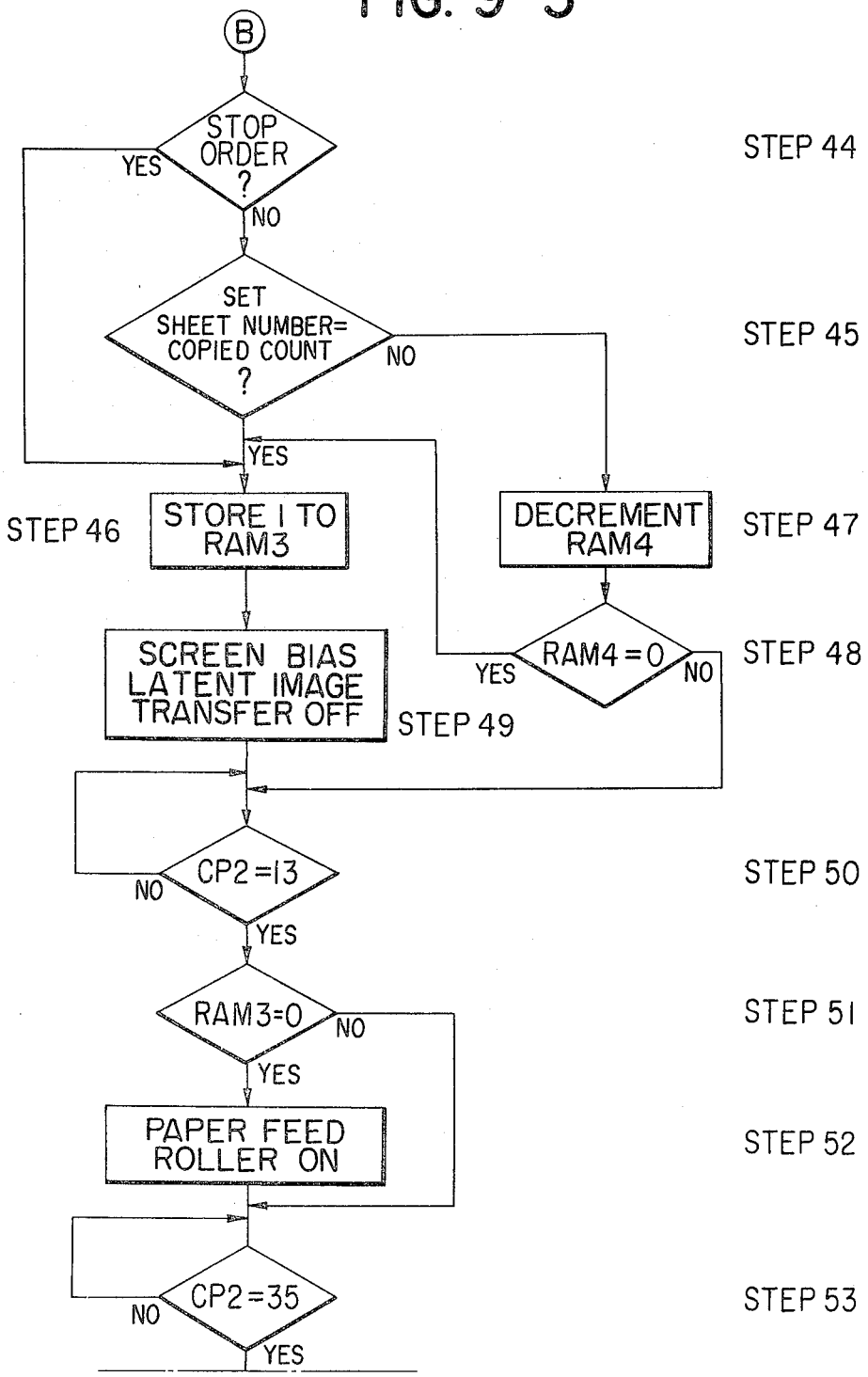

Copying Cycle:

In FIGS. 9-1' through 9-3''' there is shown a flowchart of the copying cycle. In STEP 1 whether copying sheets and toner are present or not and whether the fixing heater has been raised to a predetermined temperature or not are checked. If the answer is NO, the control halts until these conditions are met. If the answer is OK, the control advances to STEP 2 so that the drum motor (V1) is driven at a first speed. STEP 1 and STEP 2 will be described in more detail hereinafter with particular reference to FIG. 10.

In STEP 3 whether or not the optical system is in its home position is checked. If the answer is NO, the forward or going-stroke clutch is actuated to cause the optical system to be displaced to the left in FIGS. 1A and 1B by the drum motor toward the home position. After the optical system has reached the home position, the clutch is turned off in STEP 5, whereby the system is stopped. In STEP 6 it is checked whether or not the screen drum which has been already drivingly coupled to the drum motor and is rotating in synchronism therewith is in its home position. If the answer is NO, the control halts until the screen drum is brought to its home position as will be described in detail hereinafter with particular reference to FIG. 11. If the answer is YES, the control advances to STEP 7 for reproducing a copy because the optical system has been already brought to its home position.

In STEP 7, the pre-exposure lamp, first primary charger and exposure lamp are turned ON. The drum motor has been already rotating. Since in STEP 72, the drum motor which has been rotating at a second speed is turned off and the conytrol loops back to STEP 7, it must be driven again at a first speed. In the present embodiment, with one latent image 1C copies may be reproduced so that six latent images must be formed to reproduce 55 copies so that a repetitive number must be stored in RAM location 4 in STEP 7.

In STEP 8, the counter counts a number of clock pulses each generated everytime when the screen drum which is running at a first speed rotates through a unit of degrees (1°), and when it counts 60 pulses (that is when the screen drum is rotated through 60° from its reference or home position), the second primary charger is turned ON.

When CP1=105 in STEP 10, the control advances to STEP 11 where the secondary discharger is turned ON. When CP1=12 in STEP 12, the control advances to STEP 13 where the forward or going-stroke clutch is actuated to cause the optical system to be displaced to the right in FIGS. 1A and 1B.

In STEP 14, the control waits for the screen drum returning its home position.

If the frequency of the clock pulses 1 should not be in synchronism with the rotation of the screen drum or the miscounting of the clock pulses should occur during the time frame between STEP 7 and STEP 14, an error caused during one rotation of the screen drum would be accumulated with the resultant adverse effect on the sequence control. This problem may be solved by resetting in STEP 14. To the same end, STEPS 35, 57 and 61 are provided.

STEPS 15–23 are provided based upon the same principle described above and are apparent from the explanation in the boxes shown in FIGS. 9-1' through 9-3''' so that no further description shall be made in this specification. Briefly, stated, the underlying principle of the sequence control in accordance with the present invention is that the time when the control advances to the next step is stored in ROM in terms of an angle of rotation of the screen drum (that is, a number of pulses) and when a predetermined number of pulses has been counted, a predetermined processing means is turned on or off.

In STEP 24, an electrostatic latent image has been already formed on the screen drum and is to be transferred onto the insulated drum. Therefore the drum motor is switched over to a second speed from a first speed so that the counter starts counting clock pulses 2 each of which is generated every rotation of the screen drum through 1° as described elsewhere.

STEPS 24–42 are explained in the flowchart. In STEP 43 the number of reproduced copies is increased by one, and in STEP 44 it is checked whether STOP instruction is received or not. If YES, "1" is stored in Location 3 in RAM, thus indicating the finish mode. In STEP 45 it is checked whether or not the desired number of copies set in the key-entry cycle in the manner described above is coincident with a number of copies reproduced. If YES, "1" is stored in Location 3, RAM in STEP 46.

In STEP 47, the content in RAM Location 4 is reduced by 1, and in STEP 48 it is checked whether or not the content in RAM Location 4 is zero. If YES the control jumps back to STEP 46 to store "1" into RAM Location 3. If the content in RAM Location 3 is "1", the control advances to STEP 49 wherein the screen bias and latent-image-transfer charger are turned off. In like manner, in STEPS 51, 60 and 66 it is checked whether or not the condition is in the finish mode. If YES, the feed roller remains turned off in STEP 51, the developer is turned off in STEP 60, and the control halts until the screen drum is returned to its home position. In STEP 66 if RAM3=1, the control loops back to STEP 40 as will be described with reference to FIG. 17.

In STEP 68 it is checked whether the finish modes have reached a predetermined repetitive number, whether STOP instruction has been received or not and whether the number of copies reproduced has reached the preset desired number of copies. If YES, the control advances to STEP 71 where the control halts until the screen drum is returned to its home position. When the screen drum has returned to its home position, the control advances to STEP 72 to cause the drum motor to turn off. After one copying cycle has been accomplished in this manner, the control jumps back to STEP 7 so that another copying cycle may be started. On the other hand, when RAM4=0 in STEP 68, the control advances to STEP 69 and when CP2 has counted 330th pulse, the drum motor is turned off. Thus the whole copying operation has been accomplished and the control loops back to the key-entry cycle where the copying apparatus is ready to receive the next instruction.

According to the present invention, the whole operation is completed when the CP2 counts 330 pulses; that is, when the screen drum must rotate further through 30° before it reaches its home position, so that the screen drum is prevented from moving beyond its home position. Therefore in STEP 6 it is immediately checked that the screen drum is in its home position because no further rotation thereof to its home position is required.

Next programme instructions will be described for executing the above steps with the use of a microcomputer μCOM4, a product of NICHIDEN KK

| | | | |
|---|---|---|---|
| 1. | 0 1 0 0<br>Y1Y2Y3Y4 | X1X2X3X4<br>Z1Z2Z3Z4 | Adress Instruction |

X1-4 are shifted to PB3, Y1-4, to PB2 and Z1-4 to PB1.

During the execution of a programme, PC specifies a location in RCM. Then the integer "3" or binary code "0100" appears or is called on the data-code bus at T1 and is latched to the register C through SW6 and SW9 which are actuated at T2. The code is interpreted at T2 as the address instruction and concurrently X1-4 are transmitted on the bus at T2 and are latched to the register PB3 through SW9 and SW15 which are actuated at T3. Thereafter PC is increased by "1" and the codes Y1-4 and Z1-4 are transmitted and stored in PB2 and PB1, respectively. Thus a new address to be used in a programming to follow is stored in the register PB with an execution timing which is slightly different from that shown in FIGS. 4A and 4B.

| | | | |
|---|---|---|---|
| 2. | 0 1 0 1<br>Y1Y2Y3Y4 | X1X2X3X4<br>Z1Z2Z3Z4 | Jump Instruction |

When a jump condition for X is attained, Y1-4 and Z1-4 are first transferred into PB2 and PB1, respectively, and then into PC2 and PC1, respectively. If no jump condition is met, no jump is made.

X1-4=0 0 1 0 is a jump instruction when an overflow is 1; 0101, a jump instruction when the content in the register A is zero; 1000 is a nonconditional jump instruction; 1010, a jump instruction when an overflow is zero; and 1100, a jump instruction when the content in register is not 0.

Within a frame time T1+T2, PC specifies a location or address in RCM, and at T1 the code 0101 appears on the data-code bus and is latched to register C through SW6 and SW9 which are actuated at T2 simultaneous with the appearance of X1-4 on the bus. At T3 X1-4 is latched to the register D through SW7 and SW9 which are actuated at T3. If X1-4=0100, at T4 the codes "0101" and "0100" are interpreted as a jump instruction as well as an instruction for checking the contents of the register A. That is, within a time frame T5–T10, it is checked whether the content in the register A is zero or not. If not zero, PC is increased by 2 and thus the jump instruction has been executed. If zero, PC is increased by 1 the codes Y1-4 and Z1-4 are transferred into PB2 and PB1, respectively, and then into PC2 and PC1, respectively. Thus the address to which data are jumped is stored in PC, and within a next time frame of T1–T10 a new address to be jumped is specified in ROM. Thus the jump instruction has been executed.

| | | | |
|---|---|---|---|
| 3. | 0 1 1 0 | 1 0 0 0 | Shift Instruction (1) |

In response to this instruction, data in the address specified by PB is loaded into the register A. That is, within a time frame of T1+T2 an address in ROM is accessed by PC, and at T1 the code 0110 appears on the data-code bus. At T2 it is latched to the register C through Sw6 and Sw9. At T2 1000 appears on the bus and at T3 is latched to the register D through SW7 and SW9. AT T4 the codes stored in the registers C and D are interpreted and within a time frame of T5–T10 the code in PB appears on an addressing-code bus so that the data specified by this addressing-code in RAM, output device or key register in a key display input-output device appears on the data-code bus and is stored in the register A through SW9 and SW2.

Other Instructions are Summarized Below:

| Register C | Register D | Explanations |
|---|---|---|
| 4. 0111 | X1X2X3X4 | Load X1-4 into register A |
| 5. 1000 | 1000 | Store the content in the Register A into an address or location specified by PB. |
| 6. 1001 | 1100 | Execute EXCLUSIVE OR with data in the register A and the data in the address specified by PB. |
| 7. 1110 | 0001 | Transfer the content in PB into PC. |
| 8. 1110 | 0010 | Transfer the content in PC into PB. |
| 9. 1110 | 0011 | Exchange the contents between PC and PB. |
| 10. 1110 | 0100 | Increment PB by 1. |
| 11. 1110 | 0101 | Decrement PB by 1. |
| 12. 1110 | 1000 | Transfer the content in the register A into PB1. |
| 13. 1110 | 1001 | Transfer the content in the register A into PB2. |
| 14. 1110 | 1010 | Transfer the content in the register A into PB3. |
| 15. 1110 | 1011 | Transfer the content in the register A into the register B. |

-continued

| Register C | Register D | Explanations |
|---|---|---|
| 16. 1110 | 1100 | Transfer the content in the PB1 into the register A. |
| 17. 1110 | 1101 | Transfer the content in the PB2 into the register A. |
| 18. 1110 | 1110 | Transfer the content in PB3 into the register A. |
| 19. 1110 | 1111 | Transfer the content in the register B into the register A. |
| 20. 1111 | 0000 | Clear both the register A and OVF. |
| 21. 1111 | 0001 | Clear OVF. |
| 22. 1111 | 0010 | Clear the register A. |
| 23. 1111 | 0110 | Clear register A and shift OVF to the left OVF → A, A3 → OVF |
| 24. 1111 | 0111 | Clear the register A and shift OVF to the left, A1 → OVF, OVF → A3. |
| 25. 1111 | 1010 | Increment the register A by 1. |
| 26. 1111 | 1011 | Decrement by 1 the register A. |

With the above-mentioned instruction codes, the sequential copying operation is executed, and in addition the following codes are used where X=codes are not limited:

| | PC3(PB3) | PC2(PB2) | PC1(PB1) |
|---|---|---|---|
| ROM | 0000 | X | X for accessing an address in ROM |
| RAM | 0001 | X | X for accessing an address in RAM |
| OUTPUT DEVICE(1) | 0010 | X | X |
| OUTPUT DEVICE(2) | 0011 | X | X |
| OUTPUT DEVICE(3) | 0100 | X | X |
| OUTPUT DEVICE(4) | 0101 | X | X |
| INPUT DEVICE(1) | 0110 | X | X |
| INPUT DEVICE(2) | 0111 | X | X |

Of 12 conductors or lines of the addressing-code bus, the upper four digit lines are used for selecting storages, and each of memories or storages and the input-output device are provided with a conventional circuit for interpreting or decoding the transmitted codes. The remaining 8 lines are used to specificy an address in each storage, which is provided with a conventional decoding circuit. Since the input-output device has four lines each corresponding to each digit of a four-bit code, no special circuit is needed.

Figure 10:
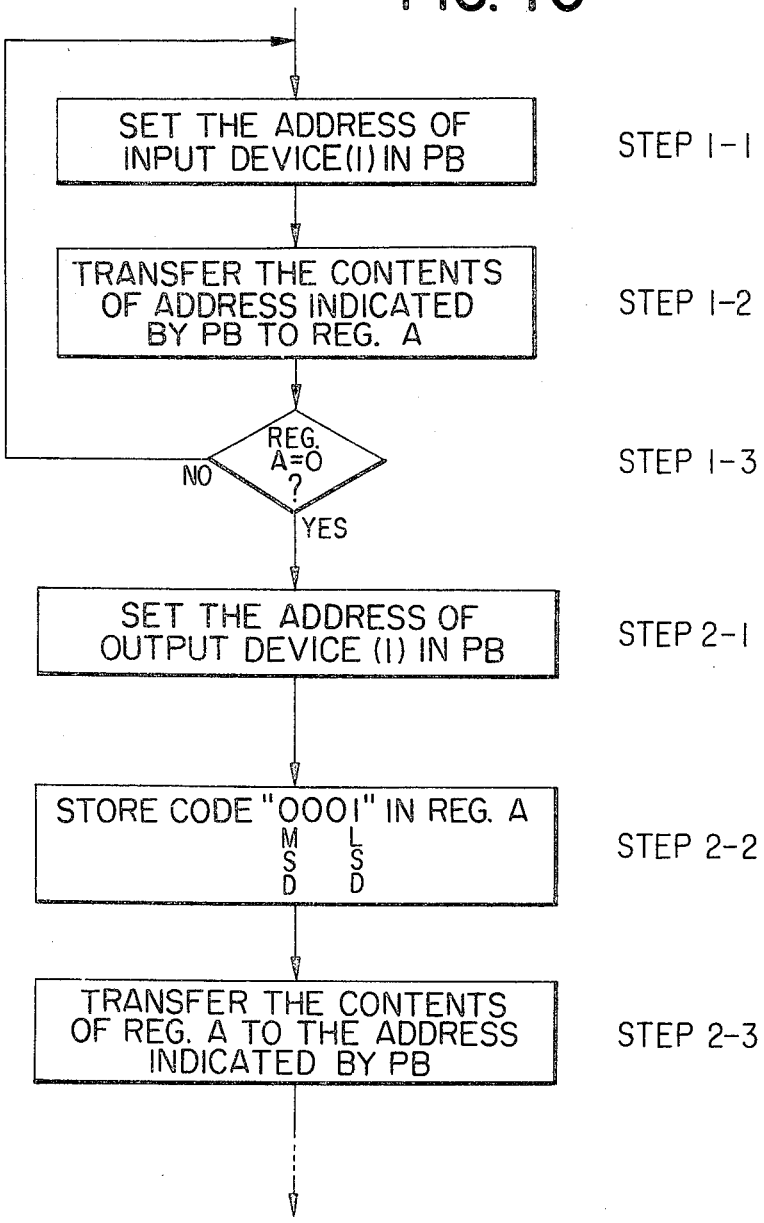
FIG. 10 shows a detailed flowchart of STEPs 1 and 2 shown in FIG. 9-1'.

Next referring to FIG. 10 steps 1 and 2 in the flowchart shown in FIG. 9 will be described. In STEP 1-1 which follows STEP 0 for key entry, the address (0 1 1 0) of the input device (1) is stored in the register PB3, and in step 1-2, the data in the input device (1) specified by the register PB3 is transferred into the register A. Within a time frame of STEPS 1-3, it is checked whether the content in the register A is 0 or not. If no, the address (0110) of the input device (1) is again stored in PB3, and the data transfer and comparison follow in the manner described above. When the content in the register A is 0; that is, when the copying cheets and toner are present, the control advances to STEP 2. In STEP 2-1, the address (0010) of the input device (1) is stored in the register PB3, and in STEP 2-2 the code (0001) is entered sequentially from the least-significant digit into the register A. In STEP 2-3, the content in the register A is transferred into the output device (1) specified by the register PB3 so that the drum motor (V1) whose latch 104 corresponds to the code (0001) in the ouput device (1).

With further reference to FIGS. 3-1' through 3-5, the above procedure will be described in more detail. First, based on TABLE 3 the operations to be executed in STEPS 1 and 2 are stored in the addresses 1–8 in ROM as follows

| STEP | Address in ROM | ROM codes |
|---|---|---|
| 1-1 | 0000 0000 0000 | 0100 0110 address code of input device (1) |
| | 0000 0000 0001 | 0000 0000 |
| 1-2 | 0000 0000 0010 | 0110 1000 |
| 1-3 | 0000 0000 0011 Register A = O | 0101 1100 jump condition, |
| | 0000 0000 0100 | 0000 0000 address to be jumped in RCM |
| 2-1 | 0000 0000 0101 | 0100 0010 address code of output device (1) |
| | 0000 0000 0110 | 0000 0000 |
| 2-2 | 0000 0000 0111 | 0111 1000 transfer code to Register A |
| 2-3 | 0000 0000 1000 | 1000 1000 |

Next the sequence from the time when the data in the address 0 in ROM is read out to the time when the motor V1 is driven will be described with further reference to FIGS. 3-1' through 3-5 and FIGS. 4A and 4B.

When the power is ON, the register PC is cleared so that within a time frame of T1-T2 the contents; that is, the codes 0000, 0000 0000 appear on the code bus consisting of 12 conductors and the address 0 in ROM is specified. Therefore at T1, the upper code (0100) in the address 0 appears on four-line data-code bus and is latched to the register C through SW9 and SW6 at T2. It is immediately decoded by the decoder CT and the control signal $\alpha$ is generated for storing into the registers PB3, PB2 and PB1 the codes which successively appear on the data-code bus. At T2, the lower code (0110) in the address 0 in ROM appears on the bus and is latched to PB3 through SW9 and SW15. Thereafter the register PC is increased by 1, and the upper code (0000) and the lower code (0000) in the address 1 in ROM sequentially appear on the bus and are latched into PB2 and PB1, respectively, in response to the control signal $\alpha$ through SW9 and SW11 until T10.

AT the next T1, the register PC is increased by 1 to specify the address 2 in ROM so that the upper code (0110) appears on the bus and is latched into the register C at T2. The lower code (1000) appears on the bus T2 and is latched into the register D at T3. These codes are decoded at T4 and with a T5–T10 cycle the codes in the registers PB; that is, (0110) (0000) (0000) appear on the addressing code bus to specify the input device (1), which in turn delivers through four-lines respective inputs in parallel to the data-code bus. These inputs are latched into the register A through SW9 and SW2 (See FIG. 14).

Applied through four input lines to the input device (1) are, as shown in TABLE 3, an output signal from the paper-out detector (1=NO (copying sheet) and 0=YES), an output signal from the toner detector (1=NO (toner) and 0=YES), an output signal from the sensor for detecting the temperature of the fixing heater (1=NG, the temperature being below a predetermined level and 0=OK, the temperature being above a predetermined level) and STOP instruction (1=YES and 0=NO). Therefore if all inputs are "0", the copying operation may be started.

At T11 DC is increased by 1 to specify the address 3 in ROM. Then the upper code (0101) and the lower code (1100) are latched into the registers C and D, respectively and decoded as a conditional jump instruction. When the content in the common register A is not zero, the registers PC are increased by 1 so that the upper code (0000) and the lower code (0000) in the address 4 in ROM are transferred into the registers PB2 and PB1, respectively, in the manner described above. Therefore the contents in PB become XXXX 0000 0000. The contents in the registers PB2 and PB1 are transferred into the registers PC2 and PC1, respectively, as described elsewhere. Thus the conditional jump instruction has been executed so that the contents in the registers PC are 0000 0000 0000. Therefore at T1, the code in the address 0 in ROM appears again on the data-code bus and the above operations are cycled.

However when the content in the register A is zero; that is, the inputs to the input device (1) are all "0" so that the copying operation may be started, the register PC is increased by 2 so that the jump instruction is skipped and at the next T1 the addressing code for specifying the address 5 in ROM appears on the addressing code bus. Therefore the address code of the output device (1) is set in the registers PB in response to the codes in the addresses 5 and 6 in ROM. Next the register PC is increased by 1 to specify the address 7 in ROM at the next T1 and the upper code (0111) is latched at T2 to the register C and decoded. Thereafter the lower code (1000) is latched to the register A through SW9 and SW2.

The register PC is further increased by 1 to specify the address 8 in RCM at T1, and the upper code (1000) is latched to the register C at T2 and at T3 the lower code (1000), to the register D and they are decoded. The code (1000) stored in the register A is called to appear on the data-code bus through SW1 and SW8 and concurrently the contents (0010 0000 0000) in the register PB is called on the addressing-code bus to specify the output device (1) and latch the data code bus to four output lines of the output device (1). As a result, the outputs are as follows:

101=0
102=0
103=0, and
104=1.

The latch 104 is connected through the interface circuit (See FIGS. 3-1' through 3-5 and 4A and 4B) to the drum motor which is driven at a first speed V1.

Figure 11:
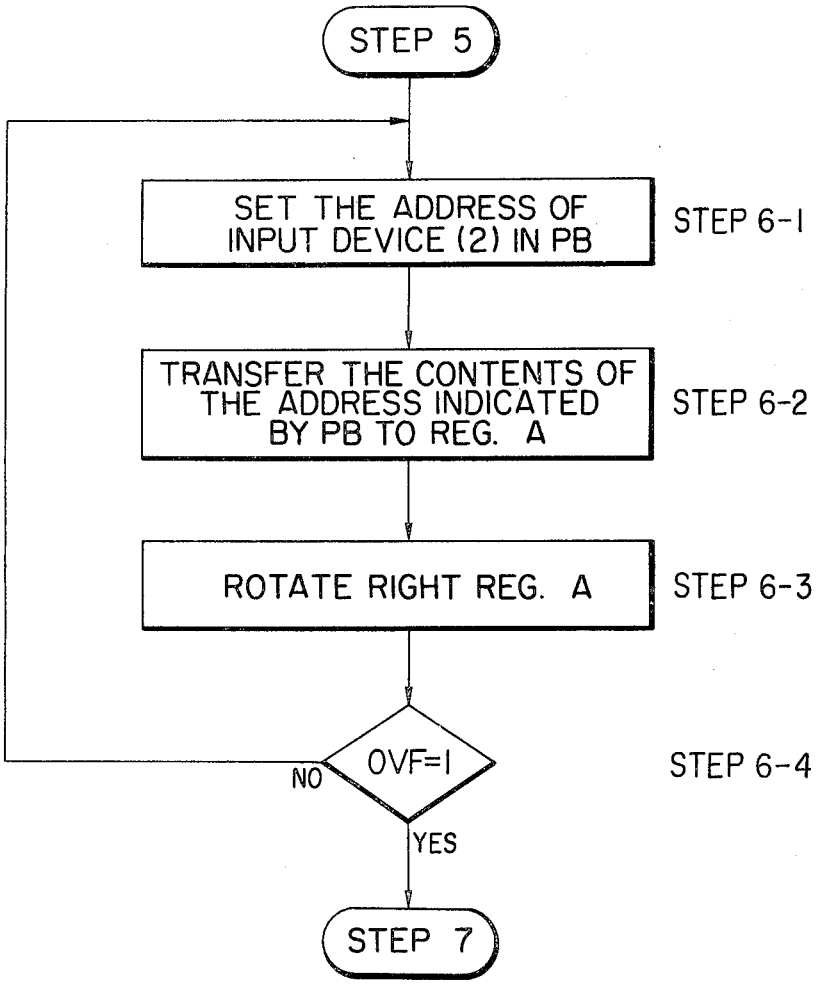
FIG. 11 shows a detailed flowchart of STEP 6 shown in FIG. 9-1'.

Next STEP 6 in the flowchart shown in FIG. 9-1' will be described in detail with reference to FIG. 11, in STEP 6 it being checked whether the drum is in its home position or not. In STEP 5, the return-stroke or backward clutch is turned off, and then in STEP 6-1, the address (0111) of the input device (2) is stored in the register PB3 and in STEP 6-2, the contents in the input device (1) specified by the register PB3 are transferred into the register A. In STEP 6-3, the contents in the register A are shifted to the right to check whether or not an overflow occurs. If no overflow occurs, STEPS 6-1, 6-2 and 6-3 are cycled. If an overflow is detected in STEP 6-4, that is, when the screen drum is detected to be in its home position, the control advances to STEP 7.

The addresses in ROM of the instruction codes are required for executing the operations in STEPS 6-1 through 6-4 are as follows:

| STEP | Addresses in ROM | | | ROM CODES |
|---|---|---|---|---|
| | 0 | 0 | 0 | |
| 6-1 | 0000 | 0000 | 0000 | 0100 0111 |
| | 0 | 1 | 1 | 1100 0000 |
| 6-2 | 0 | 1 | 2 | 0110 1000 |
| 6-3 | 0 | 1 | 3 | 1111 0111 |
| 6-4 | 0 | 1 | 4 | 0101 0010, jump if OVF = 1 |
| | 0 | 1 | 5 | 0001 0000 |

The upper code (0100) in the address 10 in ROM which is specified after the operation in STEP 5 has been executed is called on the data code bus in the manner described above and is latched to the register C and is decoded to generate the control signal $\alpha$ in response to which the next code called on the data-code bus may be stored in the register PB. That is, in response to the next clock, the lower code (0111) in the address 10 in ROM appears on the data bus and in response to the control signal $\alpha$ it is latched to the register PB3 through SW9 and SW15.

Up to the address 12 in ROM the control proceeds in the same manner with that described with reference to the addresses 0 to 2. That is, the contents in the register PB (0111 0000 0000) appear on the addressing-code bus to specify the input device (2) so that the inputs (000) applied thereto through four input lines are transferred in parallel to the data code bus and latched to the register A through SW9 and SW2. The four inputs applied to the input device (2) are, as shown in TABLE 2, an output signal from the sensor for detecting whether the screen drum is in its home position or not (1=YES and 0=NO), an output signal from a sensor for detecting whether the optical system is in its home position or not (1=YES and 0=NO), and two signals representative whether the first and second clock pulses have been detected or not (1=YES and 0=NO). Therefore, the above-mentioned code (0000) means that both the screen drum and optical system are in their home positions, respectively, and no first and second pulses have been detected.

When the address 13 in ROM is specified, the upper code (1110) is transferred into the register C whereas the lower code (0111), into the register D, and they are decoded as an instruction for shifting the register A to the right. Therefore the contents in the shift register A are shifted by one position to the right. Since (0000) are stored in the shift register A, no overflow occurs in this case.

Next the register PC is increased by 0 to specify the address 14 in ROM so that the upper code (0101) is transferred into the register C whereas the lower code (0010), into the register D and they are deducted as a conditional jump instruction for shifting the register A to the right to check if an overflow occurs. In this case, the overflow detector OVF does not detect "1" which means the overflow of the shift register A due to the shift to the right so that the register PC is increased further by 1 to specify the address 15 in ROM. The contents in the address 15 in ROM; that is (0001 0000) are called on the data-code bus, and the upper code (0001) is transferred into the register PB2 whereas the lower code (0000), into the PB1, and thereafter they are further transferred into the register PC. The addressing code for access to the address 10 in ROM is stored again and called at T1 so that the sequential steps from the address 10 in ROM to the address 13 are cycled.

However, when an overflow is detected in STEP 6-4; that is, when the contents (0001) representative of the detection the screen drum in its home position which are stored in the shift register A are shifted to the right so that the content in the overflow detector OVF becomes 1, the control signal $\alpha$ is generated which causes the register PC to increment by 2. Therefore a code of an address in ROM for jumping over the addresses to be jumped to STEP 7 is stored in the register PC.

Figure 12B:
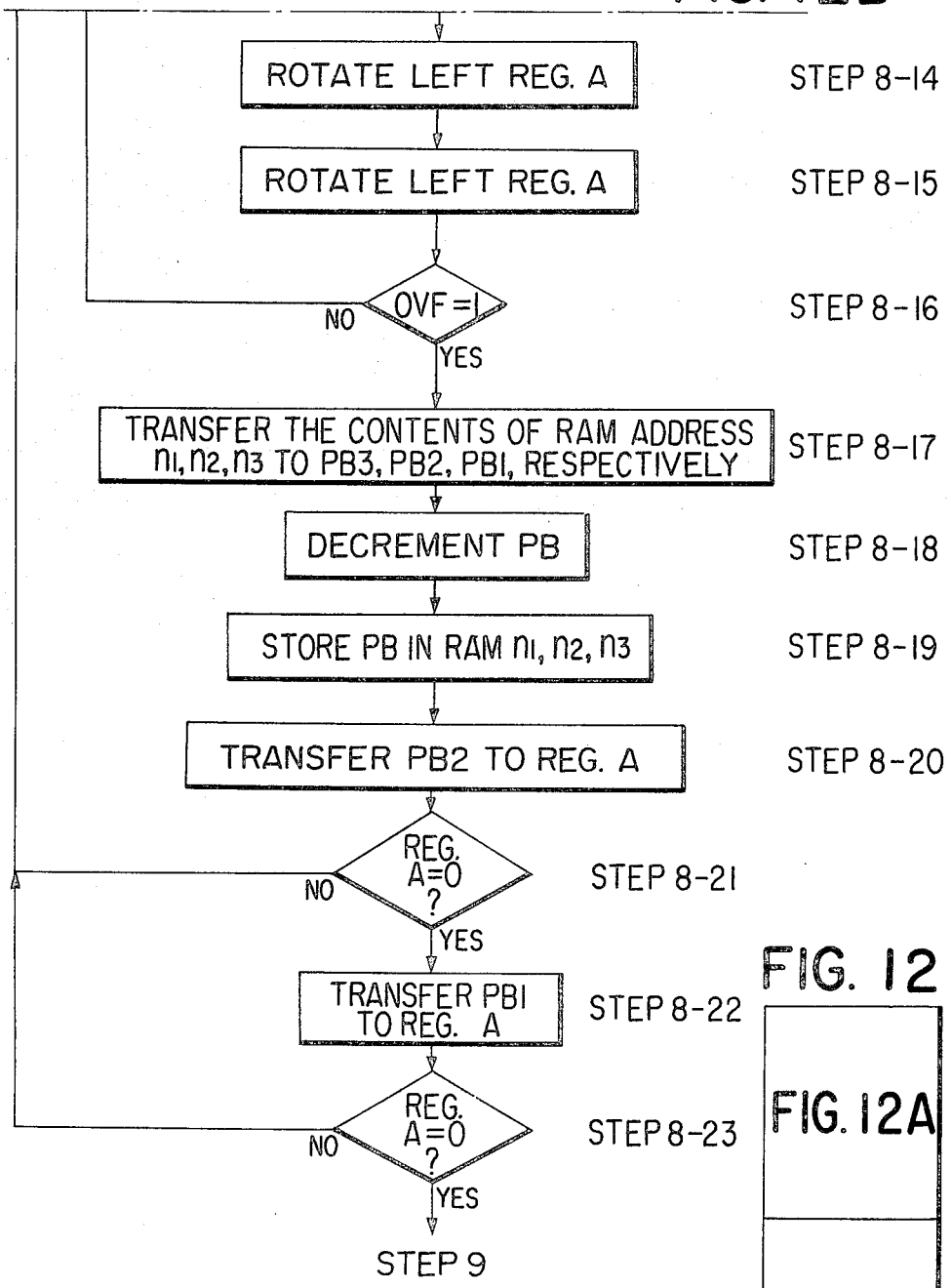
FIGS. 12A and 12B, when combined as shown in FIG. 12, show detailed flowcharts of STEP 8 shown in FIG. 9-1'' for execution of operations depending upon a number of copy clock pulses counted.
Figure 12:
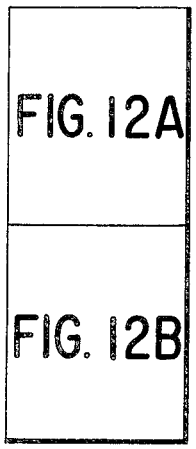
Figure 12A:
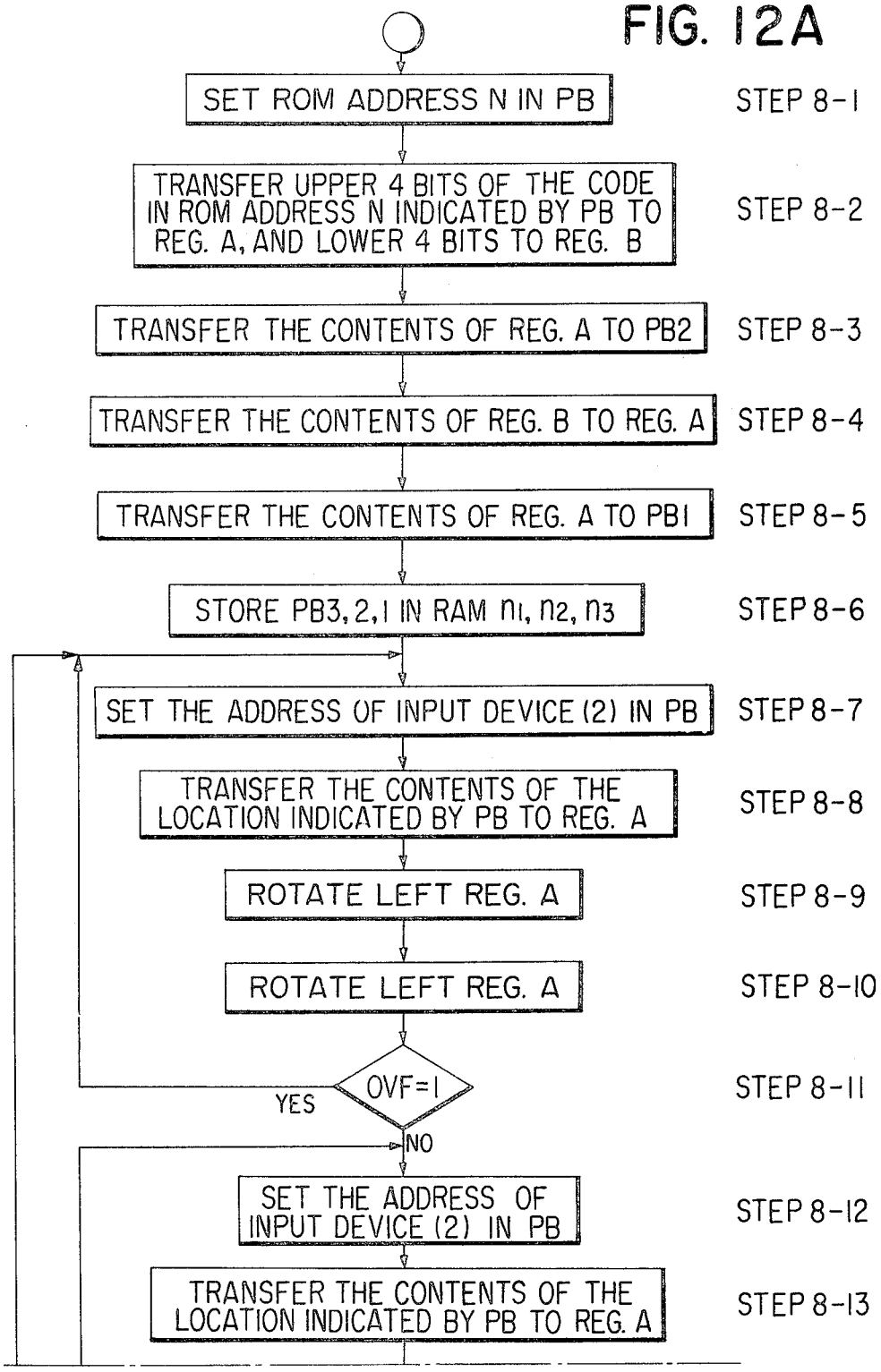

Next with reference to FIG. 12 and TABLE 4, the steps for turning the primary charger on in response to the content of the counter CP1 in STEP 8 shown in FIG. 9 will be described in more detail. In STEP 8-1, a code representative of an address N (for instance 120) in ROM where a predetermined number of 60 copy clocks is stored is set into the register PB.

TABLE 4

| STEP | Addresses in ROM | | | ROM Codes | | |
|---|---|---|---|---|---|---|
| | 0 | 2 | 0 | | | |
| 8-1 | 0000 | 0010 | 0000 | 0100 | 0000 | |
| | 0 | 2 | 1 | 1100 | 0000 | "OCO" |
| 8-2 | 0 | 2 | 2 | 1101 | 0000 | |
| 8-3 | 0 | 2 | 3 | 1110 | 1001 | |
| 8-4 | 0 | 2 | 4 | 1110 | 1111 | |
| 8-5 | 0 | 2 | 5 | 1110 | 1000 | |
| 8-6 | 0 | 2 | 6 | 0010 | 0001 | |
| 8-7 | 0 | 2 | 7 | 0100 | 0111 | |
| | 0 | 2 | 8 | 0000 | 0000 | |
| 8-8 | 0 | 2 | 9 | 0110 | 1000 | |
| 8-9 | 0 | 2 | A | 1110 | 0110 | |
| 8-10 | 0 | 2 | B | 1111 | 0110 | |
| 8-11 | 0 | 2 | C | 0101 | 0010 | jump if OVF = 1 |
| | 0 | 2 | D | 0010 | 0110 | |
| 8-12 | 0 | 2 | E | 0100 | 0111 | |
| | 0 | 2 | F | 0000 | 0000 | |
| 8-13 | 0 | 3 | 0 | 0110 | 1000 | |
| 8-14 | 0 | 3 | 1 | 1111 | 0110 | |
| 8-15 | 0 | 3 | 2 | 1111 | 0110 | |
| 8-16 | 0 | 3 | 3 | 0101 | 1010 | jump if OVF ≠ 1 |
| | | | | 2 | E | |
| | 0 | 3 | 4 | 0010 | 1110 | |
| 8-17 | 0 | 3 | 5 | 0011 | 0001 | |
| 8-18 | 0 | 3 | 6 | 1110 | 0100 | |
| 8-19 | 0 | 3 | 7 | 0010 | 0001 | |
| 8-20 | 0 | 3 | 8 | 1110 | 1101 | |
| 8-21 | 0 | 3 | 9 | 0101 | 1100 | jump if Register A ≠ 0 |
| | | | | 2 | 7 | |
| | 0 | 3 | A | 0010 | 0111 | |
| 8-22 | 0 | 3 | B | 1110 | 1100 | |
| 8-23 | 0 | 3 | C | 0101 | 1100 | |
| | 0 | 3 | D | 0010 | 0111 | |

In STEP 8-2, the upper code (1101) and the lower code (0000) stored in the address 22 in ROM are called and transferred into the registers C and D, respectively, and then decoded and the above addressing code in the register PB is called on the addressing code bus to specify the read-only memory and its address 120. The content "60" (which is equal to a number of clocks to be counted) in the address 120 is called on the data-code bus.

In the present embodiment, the level 0 of the copy clock is detected first so that the rise of the copy clock signal may be detected for counting.

In STEP 8-20 the contents in the register PB2 are transferred into the register A (The contents in the register PB remain unchanged ever after STEP 8-19 has been executed.), and in STEP 8-21 the content in the register A; that is, the most significant bit of the decremented numeral code is detected to be 0 or not. In STEP 8-23 it is checked whether the least significant digit of the numeral code is 0 or no. Thus the counting step has been accomplished.

The frequency of the clock pulses $\phi$ for the computer CPU is 1 microsecond and a time or cycle required for executing the counting steps is about 30 steps so that one step requires (10 clocks$\times$1 microsecond) or 300 microseconds at the most. Since the frequency of the copy clock pulses is about 8 miliseconds as described above, it will not adversely affect the counting.

Figure 14:
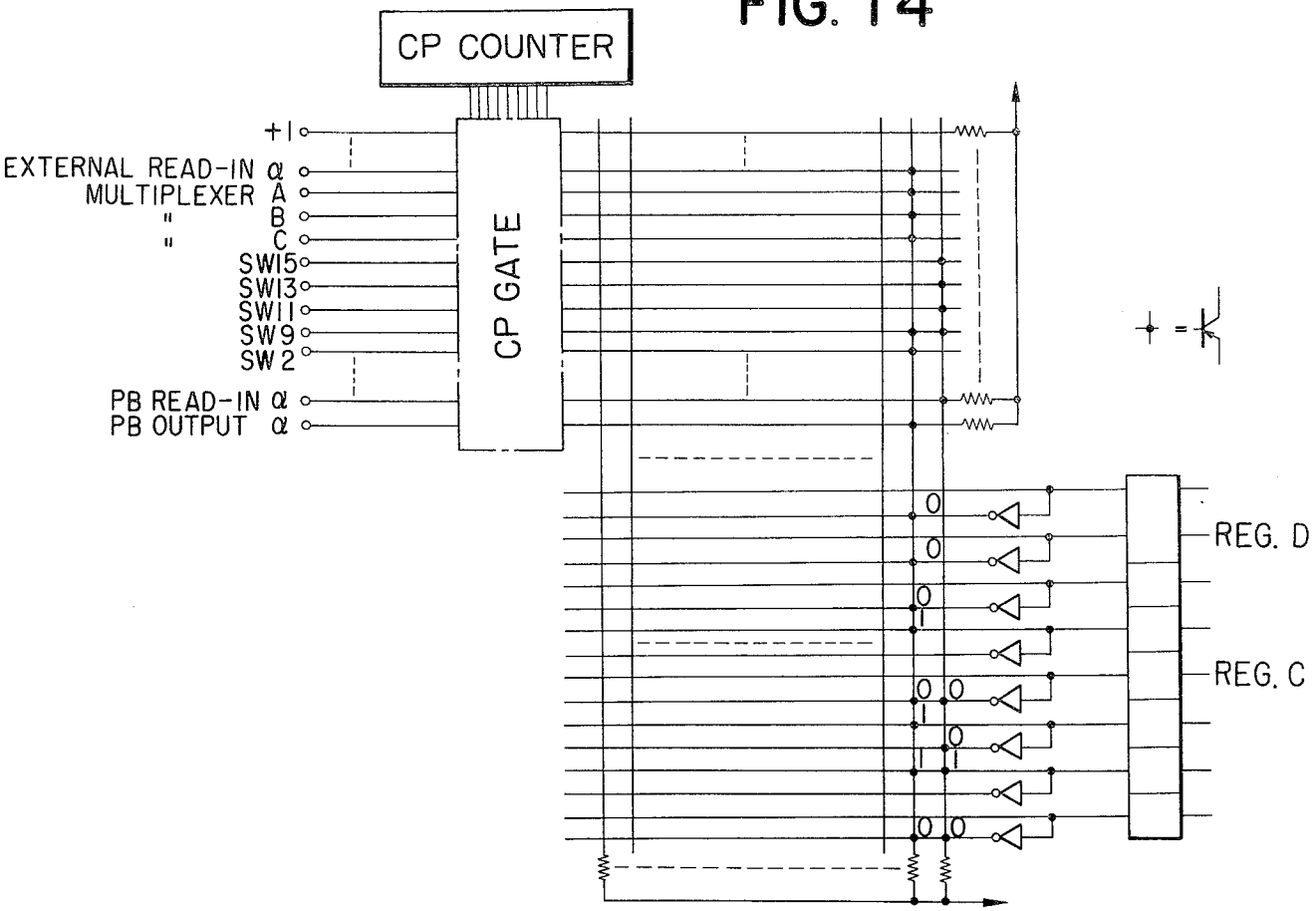
FIG. 14 is a circuit diagram of a controller.

In FIG. 14 there is shown a circuit diagram of the control unit or controller for decoding the instruction and data codes from ROM and generating the circuit signal $\alpha$ in accordance with the above described procedures will be described. The circuit shown in FIG. 14 is so arranged as to accomplish the operations in respective steps shown in FIG. 10, but it will be understood that a control circuit may be designed to accomplish the operations in other steps. In FIG. 14 a CP gate is provided so that an output may be derived when a predetermined number of clock pulses $\phi$ has been counted.

The screen drum in its home position is represented by an output signal "1" which is generated by an optical sensor 67 when it detects a mark 68 (See FIG. 1B). The condition that there is no copying sheet available is represented by an output signal "1" generated by the optical sensors 80 and 81 (See FIG. 1B). The condition that no toner is available is represented by the signal "1" from a Hall-effect integrated-circuit 32 which is actuated by a lever (See FIG. 16-6).

Figures 1, 17:
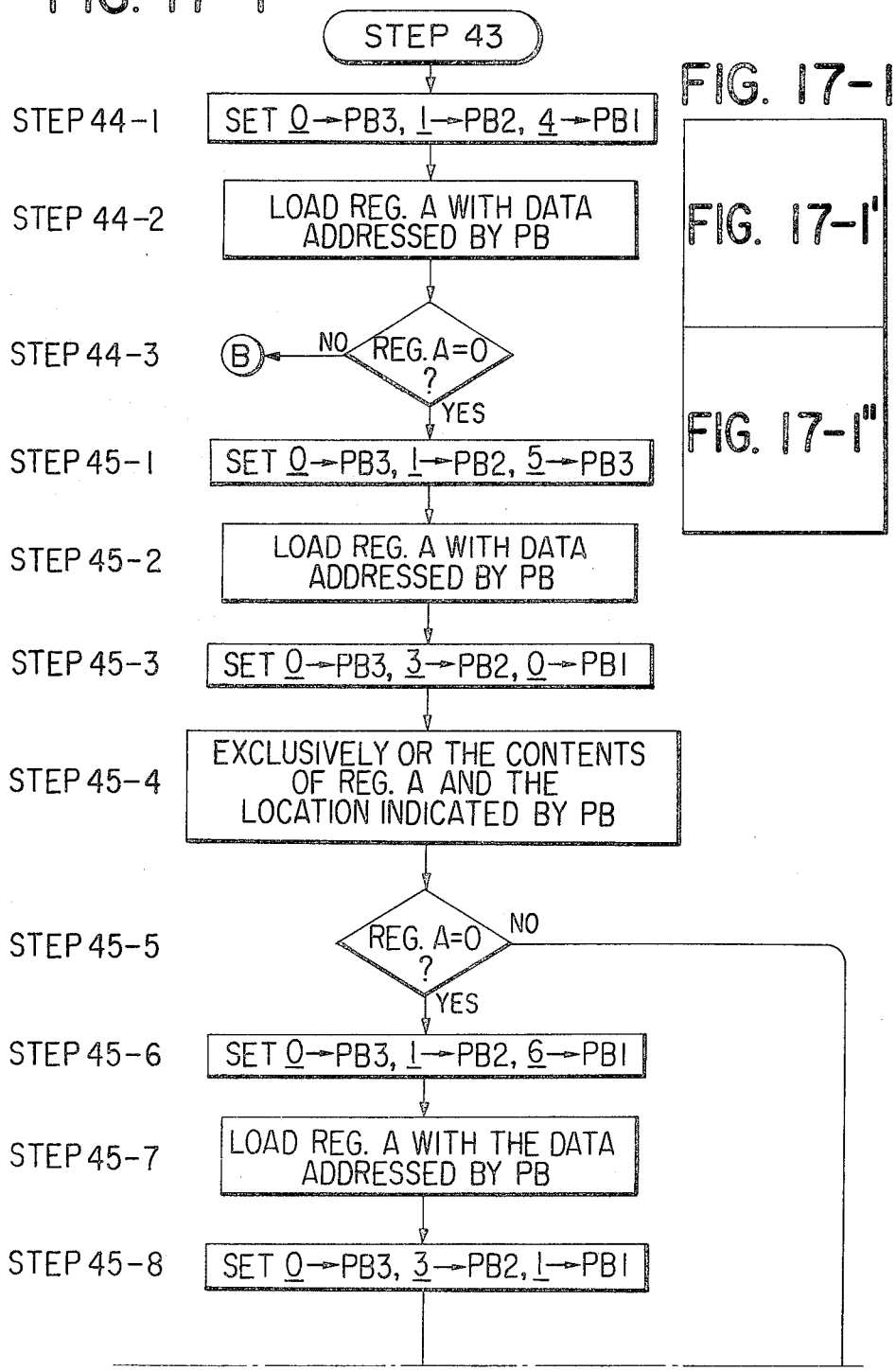
Figures 1, 17:
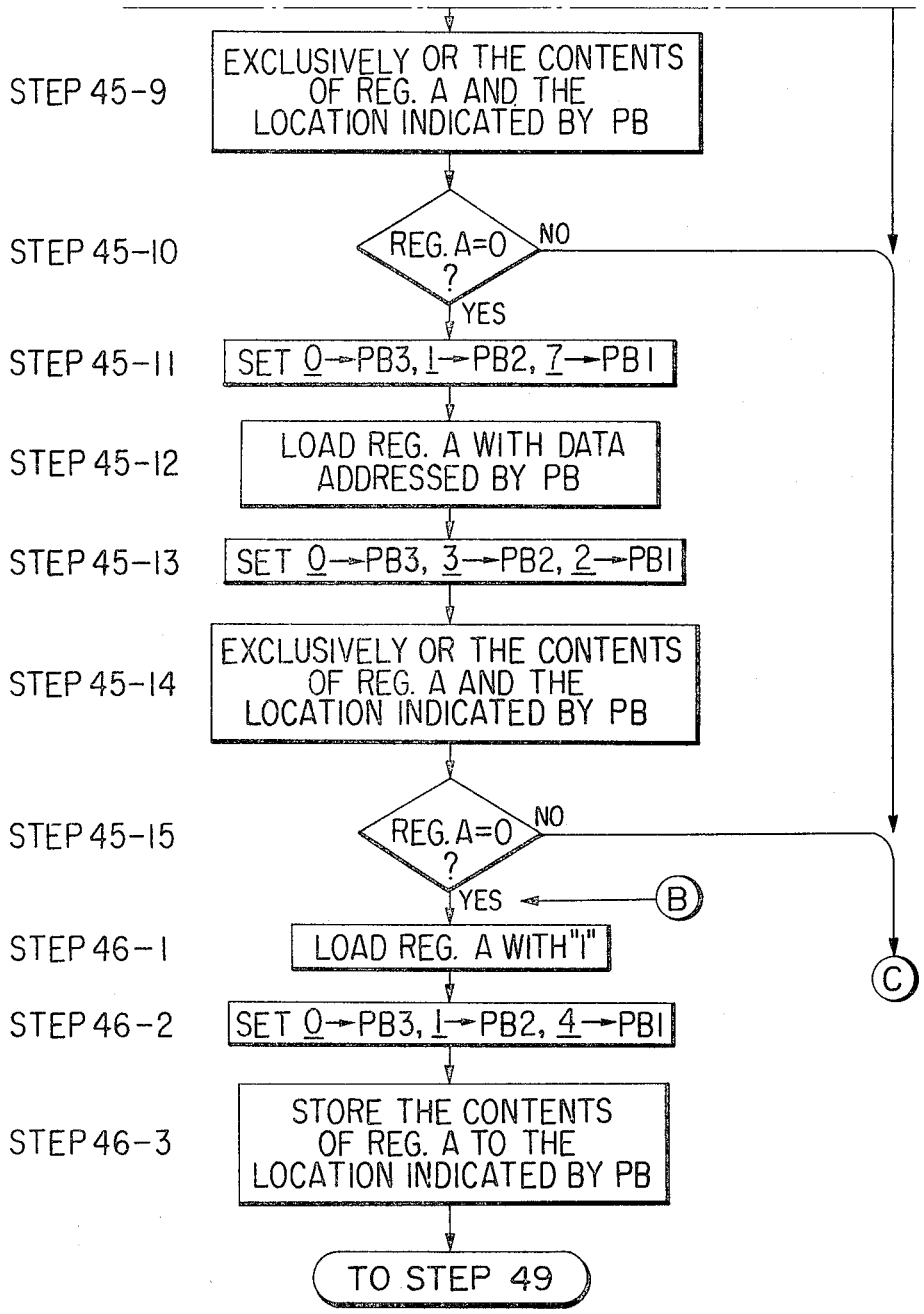

In FIGS. 17-1' and 17-1'' there is shown an instruction flowchart for executing the operations in STEPS 44, 45 and 46 of FIG. 9-3'. It is assumed that the following data are stored in the addresses in RAM.

| ADDRESSES | | | DATA STORED |
|---|---|---|---|
| 015 3rd digit | 016 2nd digit | 017 1st digit | a number of copies reproduced which is entered in STEP 47 |
| 030 3rd digit | 031 2nd digit | 032 1st digit | a desired number of copies, which is entered in STEP 0. |
| 014 | | | code representative of FINISH mode (RAM 3) |
| 01A 2nd digit | 01B 1st digit | | a repetitive number, which is entered in STEP 7 (RAM 4) |

In FIG. 17, 0, 1, 4 represents the address 014 in RAM 3.

In TABLE 5, there are shown codes which correspond to the instructions shown in FIGS. 17-1' and 17-1'' and are stored in ROM.

TABLE 5

| STEP | Addresses in ROM | ROM Codes MSB | ROM Codes LSB |
|---|---|---|---|
| STEP 44-1 | 1 0 0 | 0100 | 0000 |
| | 1 0 1 | 0001 | 0100 |
| STEP 44-2 | 1 0 2 | 0110 | 1000 |
| STEP 44-3 | 1 0 3 | 0101 | 0100 |
| | 1 0 4 | 0001 | 1100 |
| STEP 45-1 | 1 0 5 | 0100 | 0000 |
| | 1 0 6 | 0001 | 0101 |
| STEP 45-2 | 1 0 7 | 0110 | 1000 |
| STEP 45-3 | 1 0 8 | 0100 | 0000 |
| | 1 0 9 | 0011 | 0000 |
| STEP 45-5 | 1 0 A | 1001 | 1100 |
| STEP 45-5 | 1 0 B | 0101 | 1100 |
| | 1 0 C | 0101 | 0000 |
| STEP 45-6 | 1 0 D | 0100 | 0000 |
| | 1 0 E | 0001 | 0110 |

TABLE 5-continued

| STEP | Addresses in ROM | ROM Codes MSB | LSB |
|---|---|---|---|
| STEP 45-7 | 1 0 F | 0110 | 1000 |
| STEP 45-8 | 1 1 0 | 0100 | 0000 |
| | 1 1 1 | 0011 | 0001 |
| STEP 45-9 | 1 1 2 | 1001 | 1100 |
| STEP 45-10 | 1 1 3 | 0101 | 1100 |
| STEP 45-11 | 1 1 5 | 0100 | 0000 |
| | 1 1 6 | 0001 | 0111 |
| STEP 45-12 | 1 1 7 | 0110 | 1000 |
| STEP 45-13 | 1 1 8 | 0100 | 0000 |
| | 1 1 9 | 0011 0010 | |
| STEP 45-14 | 1 1 A | 1001 | 1100 |
| STEP 45-15 | 1 1 B | 0101 | 1100 |
| | 1 1 C | 0101 | 0000 |
| STEP 46-1 | 1 1 D | 0111 | 0001 |
| STEP 46-2 | 1 1 E | 0100 | 0000 |
| | 1 1 F | 0001 | 0100 |
| STEP 46-3 | 1 2 0 | 1001 | 1100 |
| STEP 49 | | | |
| \| | \| | \| | \| |
| STEP 47, 48-1 | 1 5 0 | 0100 | 0000 |
| | 1 5 1 | 0001 | 1011 |
| STEP 47, 48-2 | 1 5 2 | 0110 | 1000 |
| STEP 47, 48-3 | 1 5 3 | 1111 | 1011 |
| STEP 47, 48-4 | 1 5 4 | 0101 | 1010 |
| | 1 5 6 | 0110 | 0001 |
| STEP 47, 48-5 | 1 5 7 | 1111 | 0001 |
| STEP 47, 48-6 | 1 5 8 | 1000 | 1000 |
| STEP 47, 48-7 | 1 5 9 | 1110 | 0101 |
| STEP 47, 48-8 | 1 5 A | 0110 | 1000 |
| STEP 47, 48-9 | 1 5 B | 1111 | 1011 |
| STEP 47, 48-10 | 1 5 C | 0101 | 1010 |
| | 1 5 D | 0110 | 0001 |
| STEP 47, 48-11 | 1 5 E | 1111 | 0001 |
| STEP 47, 48-12 | 1 5 F | 0101 | 1000 |
| | 1 6 0 | 0001 | 1101 |
| STEP 47, 48-13 | 1 6 1 | 1000 | 1000 |
| STEP 50 | | | |
| \| | \| | \| | \| |

No further description of FIGS. 17-1' and 17-1'' and TABLE 5 because they themselves suffice for the understanding thereof.

Figure 13:
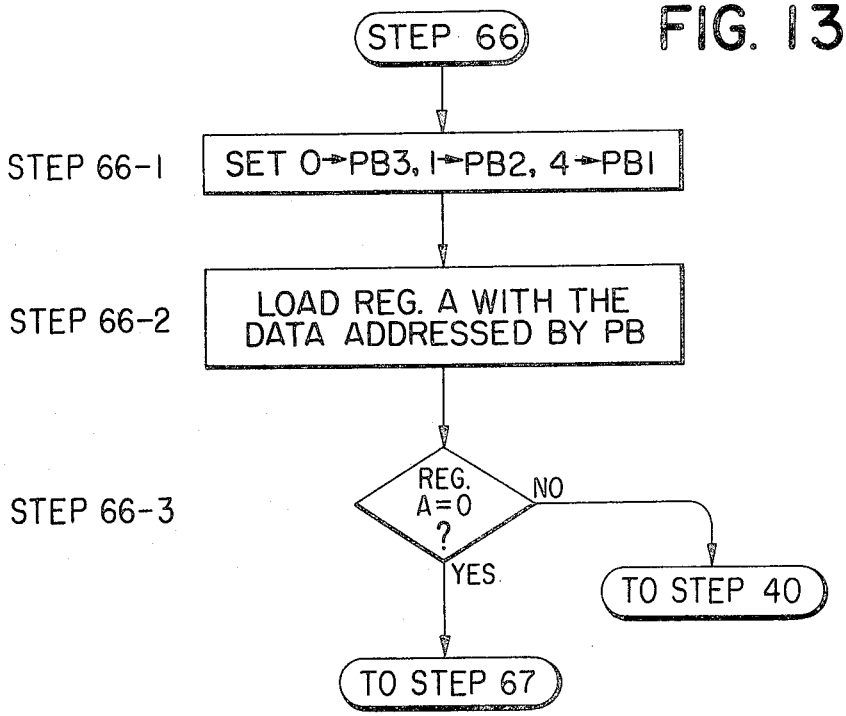
FIG. 13 shows a detailed flowchart of STEP 66 shown in FIG. 9 for stopping the copying cycle.

In FIG. 13 there is shown a flowchart for STEP 66 or the decision whether FINISH mode has been reached or not, and the codes stored in ROM for this purpose are shown in TABLE 6.

TABLE 6

| STEP | Addresses in ROM | ROM Codes | |
|---|---|---|---|
| STEP 66-1 | 2 0 0 | 0100 | 0000 |
| | 2 0 1 | 0001 | 0100 |
| STEP 66-2 | 2 0 2 | 0110 | 1000 |
| STEP 66-3 | 2 0 3 | 0101 | 0100 |
| | 2 0 4 | 0011 | 0110 |
| STEP 67 | 2 0 5 | | |
| \| | \| | | |
| STEP 40 | 2 3 6 | | |

In FIGS. 15A through 15D there is shown a more detailed circuit diagram of the devices shown in FIGS. 3-1' through 3-5. CPV(2-1) is NOP 711, a product of NIPPON DENKI K. K.; ABO-7, addressing code outputs to ROM and RAM chips; AB8-11, outputs connected to a chip-selecting chip (1-1) for selecting a chip; DBO-3, data input-output lines; R/W, a read-write instruction signal; $\phi$, a clock signal; SA, a sub-address line for the four-bit time-division of the output from ROM; RES, a reset line for resetting the chip when the power is turned on; CDF, a line through which a signal for deactivating CPV such as FSTOP signal from STOP key is applied; CTF, a line calling for one program instruction directly from CPU; and F, an output line for transmitting the read instruction (See also FIGS. 4A and 4B, timing chart).

(1-1) is the chip-selecting chip which decodes the upper four bits of the 12-bit addressing code from CPU for transmitting CS signal through one of the output lines 1-8, thereby selecting a required chip.

(2-1)-(2-4) are ROM chips each address of which is specified by the AB lines. They are of the conventional matrix type. D1-8 are output lines.

Latch circuit chips (3-3) and (3-4) latch four bits of their respective outputs.

Figure 4A:
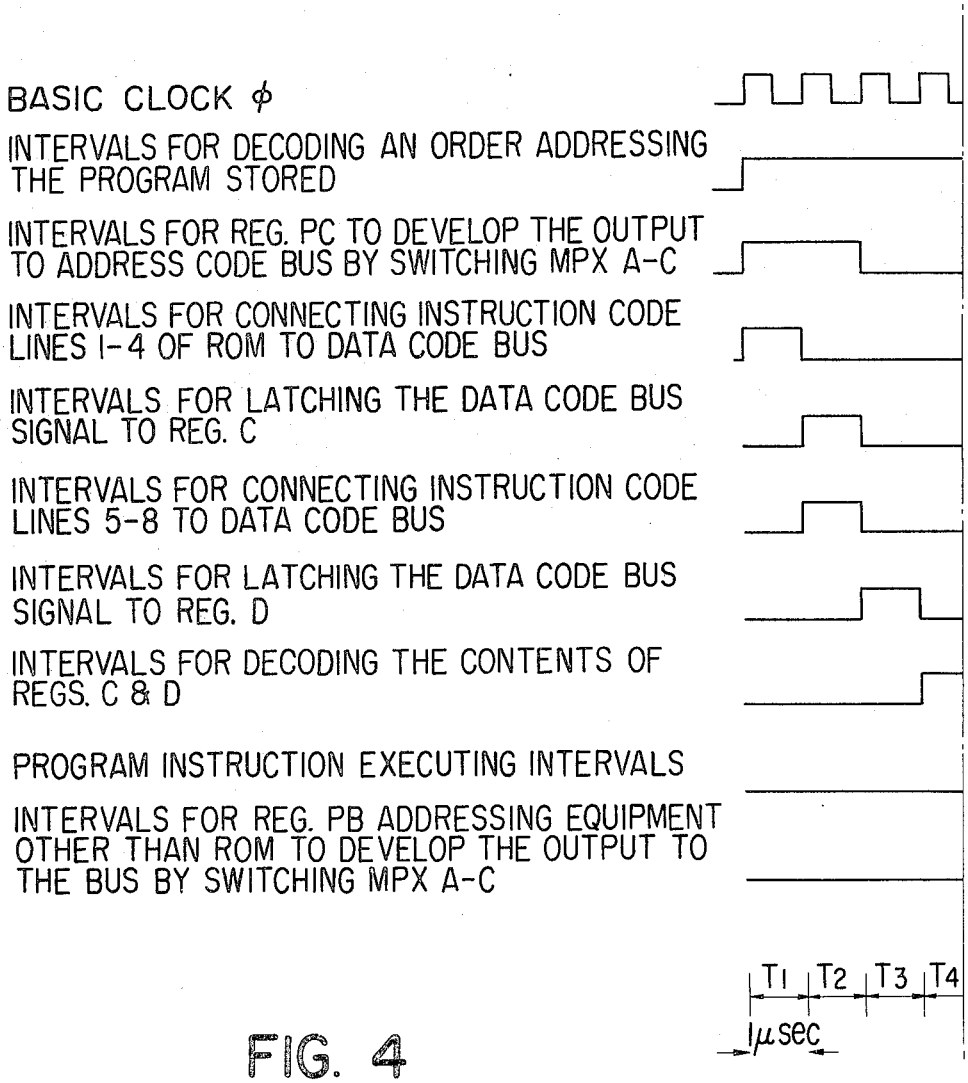
Figure 4:
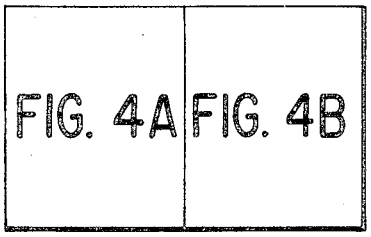
Figure 4B:
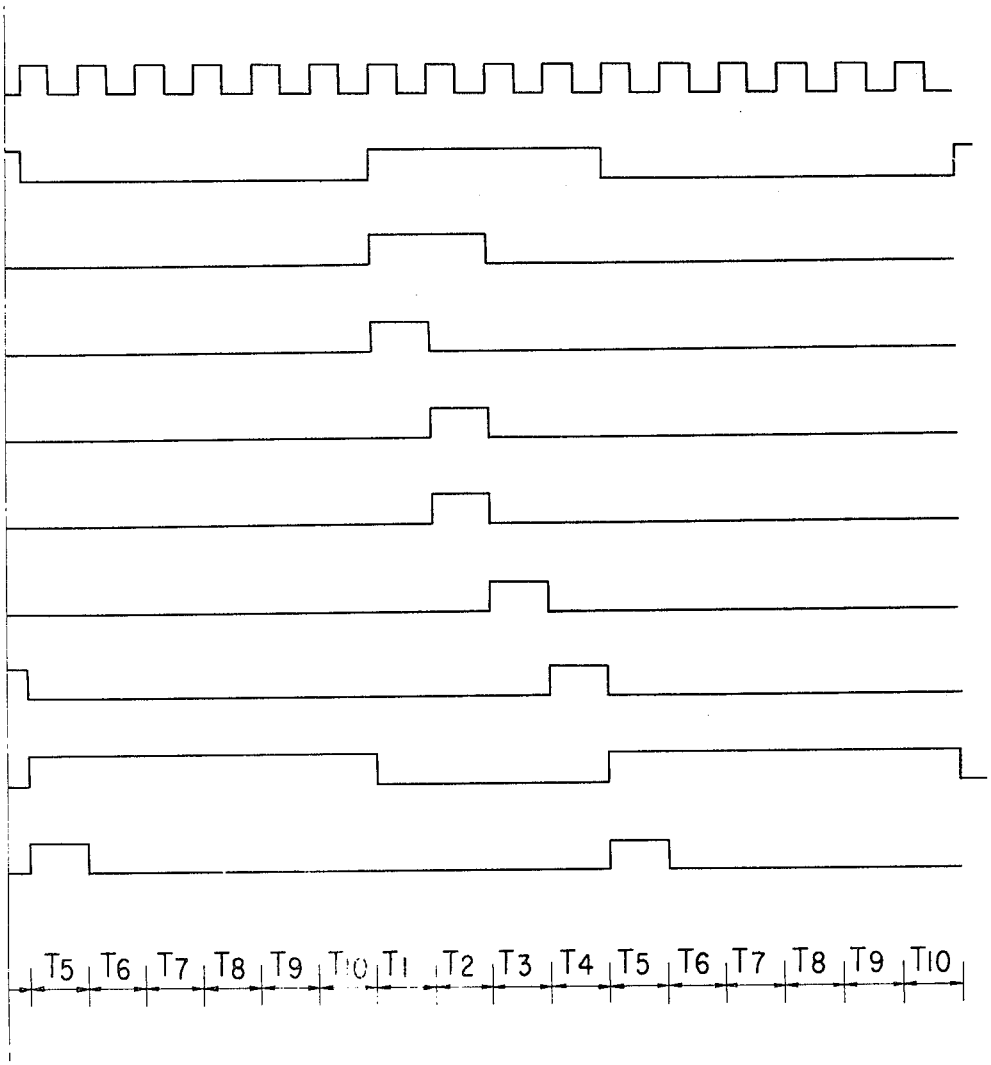
Figure 5:
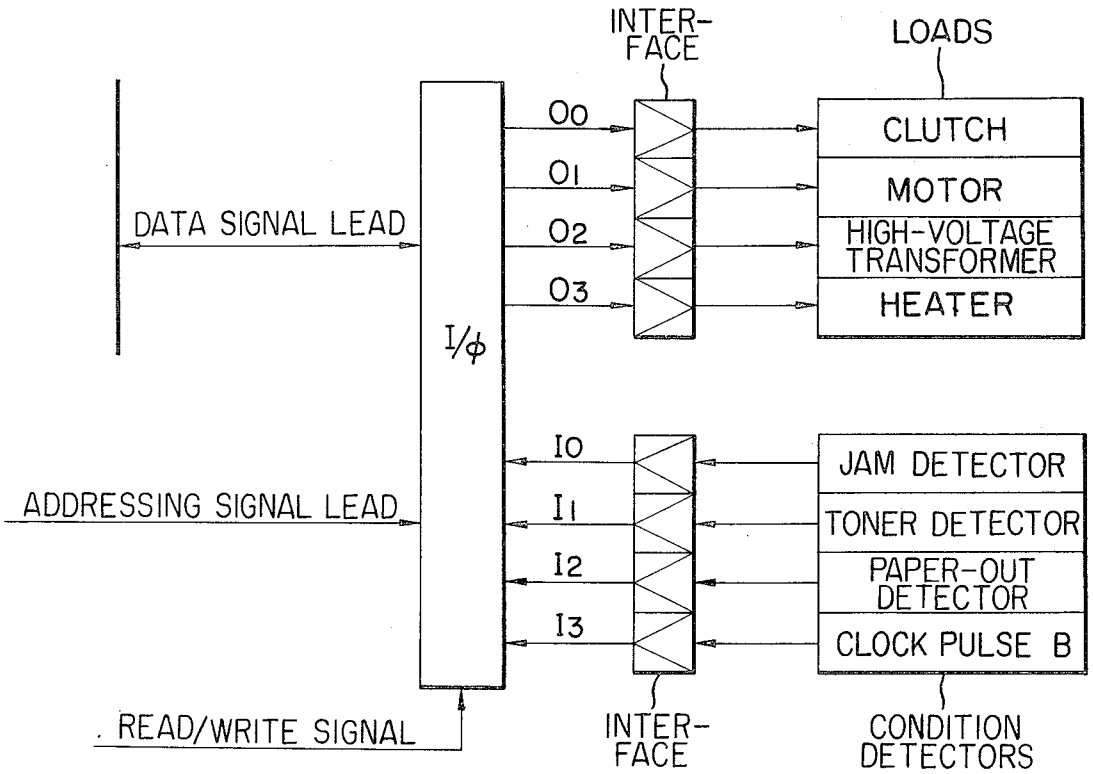

Multiplexers (4-1)-(4-4)transfer the outputs from the latch circuit chips (3-3) and (3-4) four bits at one time to FF(5-1) in order to obtain the timing relationship shown in FIGS. 4A and 4B.

Figures 1, 2, 16:
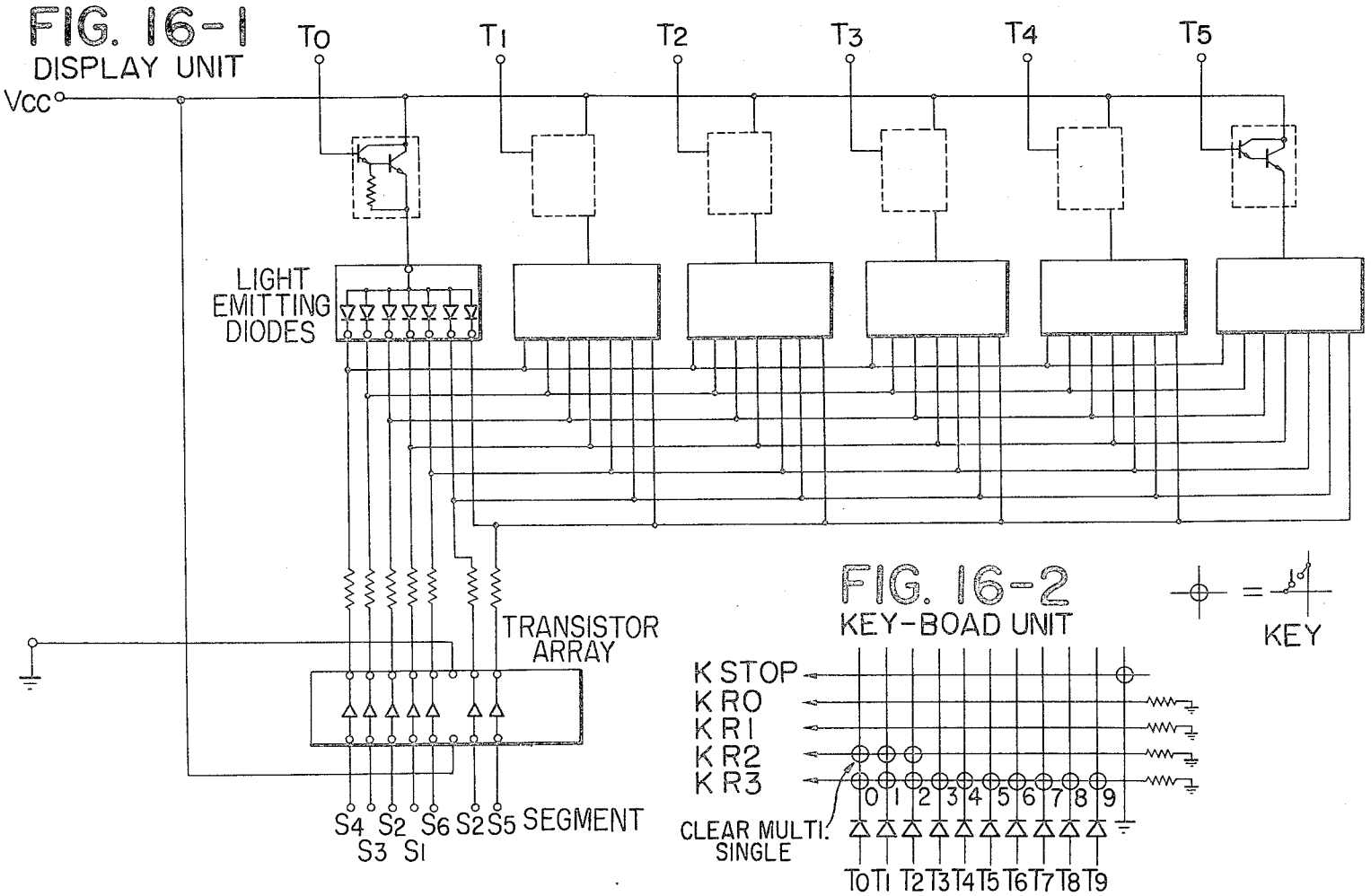

A key display circuit (6-2) is shown in more detail in FIG. 16-1. Each display unit consists of 7 light-emitting-diode segments $S_1$-$S_7$. Synchronous lines $T_0$-$T_9$ are provided in order to dynamically indicate keyed inputs.

The output circuits (7-1)-(7-4) and input circuits (8-1)-(8-2) which are shown in more detail in FIGS. 16-3 and 16-4 are connected through the DB lines to the computer CPU.

(8-3) is a circuit for determining an address for starting writing in ROM when the copying operation is started.

Figure 18:
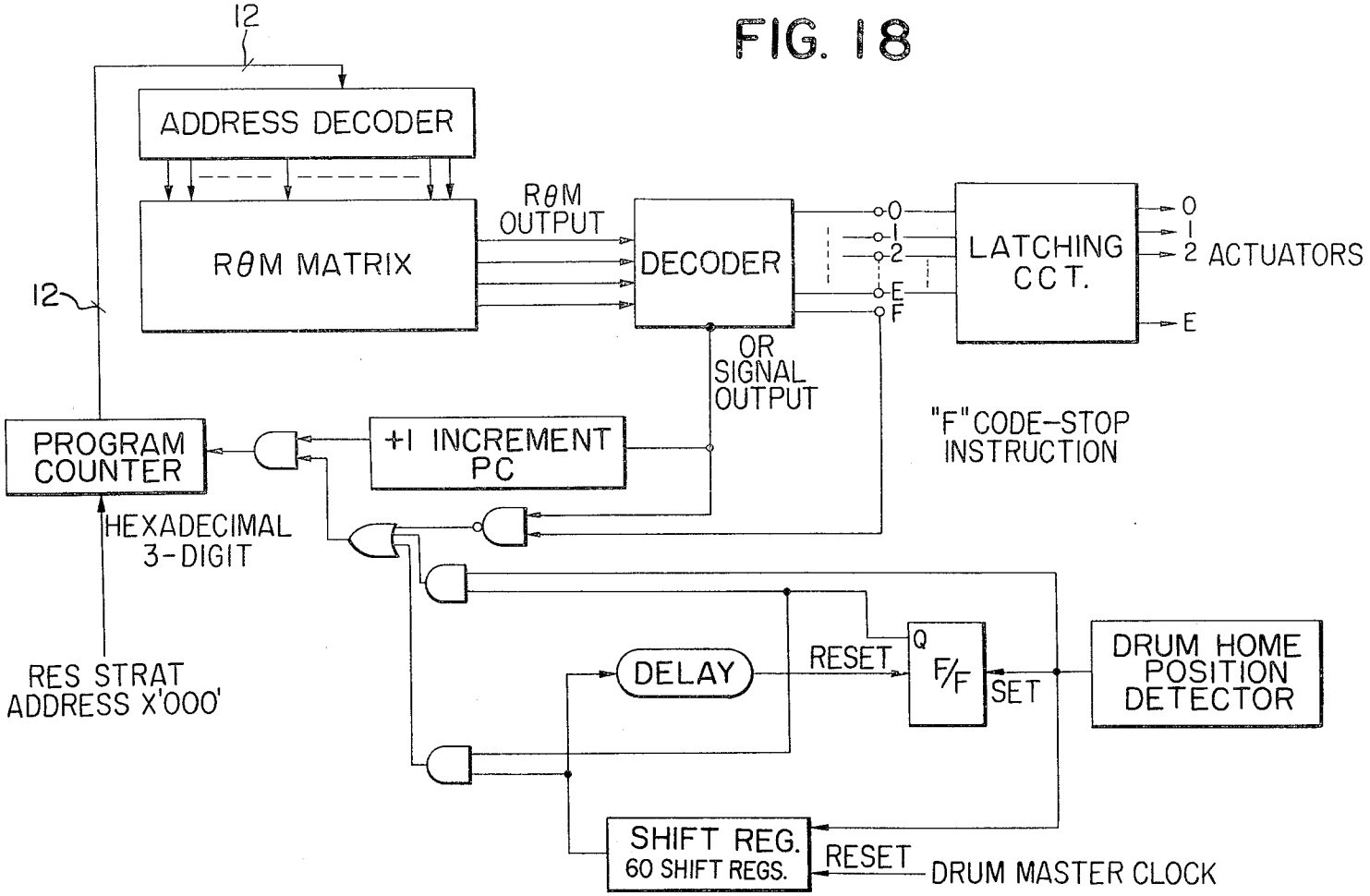
FIG. 18 is a circuit diagram of a ROM reading-out circuit.

In FIG. 18 there is shown a diagram of a circuit for controlling the process for calling data from ROM by counting the drum master clocks or by the detection of the screen drum in its home position. A program counter PC is incremented by one so that data may be sequentially called starting from an address X000 in ROM. Outputs 0-4 from a decoder are connected through a latching circuit to loads. When a designated address in ROM is accessed, an output signal is derived from an output terminal F of the decoder and is transmitted to the program counter PC so that the increment by 1 thereof may be interrupted and consequently the reading of ROM may be stopped. When the screen drum is rotated and brought to its home position again, the program counter PC is incremented by 1 so that a next address in ROM may be accessed. Instead of a circuit for incrementing by 1 the program counter PC, and AND gate may be employed to which are applied a step clock and an output from the output terminal X from the decoder. The "1" output may be derived from the X output terminal when the output "1" is derived from one of the output terminals O-F. Same is true when the drum clocks are counted.

In the dry copying machine described above, the processing time is stored in the read-only memory and in like manner the present invention may be applied to a wet type copying machine so that an idle rotation (more than one rotation) of a drum before and after an effective processing may be stored in terms of a number of clocks.

What we claim is:

1. A copying or printing machine comprising a recording-medium, actuatable elements for forming images on said recording medium, sensing elements for detecting operational conditions of the machine or for receiving operational commands, and control means including a random-access memory and a read-only memory having programs stored for controlling the actuation of said actuatable elements in a predetermined sequence to form an image on said recording medium in response to the programs and inputs from said sensing elements, wherein said control means further comprises a common register associated with said actuatable elements and said sensing elements, said common register having a number of parallel bit positions for applying signals for control of said actuatable elements and for receipt of signals from said sensing elements, wherein more than one of said actuatable elements or sensing elements are interconnected to a respective one bit position of said common register, said one bit position being associated with a control signal for control of the respective actuatable elements or with a sensing signal from a respective sensing element, further comprising an output latch means which has a corresponding number of parallel bit positions and coupled between said actuatable elements and said common register, said actuatable elements being controlled by a latch signal during the time of operation thereof through such output latch means.

2. A copying or printing machine as set forth in claim 1, further comprising input and output means, wherein said register is connected through said input and output means to said actuatable elements and said sensing elements.

3. A machine in accordance with claim 1, wherein said latch means includes a plurality of registers each having said parallel bit positions, one of said registers being elected to control the latch operation of said actuatable elements.

4. A machine in accordance with claim 1, wherein at least one of said actuatable elements and at least one of said sensing elements are interconnected to one bit position of said common register.

5. A machine in accordance with claim 1, wherein the bits of said common register are checked to determine the enablement of image formation.

6. A machine in accordance with claim 1, wherein the bits of said common register are set to start an image formation operation.

7. A copying or printing machine comprising a recording medium, a plurality of discriminatively actuatable elements for forming images on said recording medium, sensing elements for detecting operational conditions of the machine or for receiving operational commands, a read-only memory for storing microprograms for image formation, a random-access memory for storing data, and control means for controlling said actuatable elements in response to the microprograms and said sensing elements, wherein said control means further comprises a common register associated with said sensing elements, said actuatable elements, and said read-only memory, said common register having parallel bit positions for applying signals for control of said actuatable elements and for receiving signals which said sensing elements produce in accordance with sensing operations, and wherein signals stored in said common register are tested bit by bit during a bit shift operation of said common register to determine the sensing operations of said common register, and further comprising input means and output means coupled between said actuatable elements or sensing elements and said common register, one of said input means and output means being selected to be provided with control signals from said common register, operation of said actuatable elements and input of said sensing elements being controlled through said one of said input means and output means, at least one of said actuatable elements and at least one of said sensing elements being interconnected to one bit position of said common register, said output means generating latch signals bit by bit during the time of operation of said actuatable element.

8. A machine in accordance with claim 7, wherein bits of said common register are checked to determine the enablement of image formation.

9. Copying or printing apparatus comprising:

copy forming means including a plurality of actuatable elements for actuation in a predetermined sequence for the formation of copies;

a plurality of input elements for generating signals corresponding to different conditions of said apparatus, respectively;

memory means for storing a copy forming program comprising instructions for the actuation of said actuatable elements in said predetermined sequence; and control means for controlling the actuation of said actuatable elements in response to said copy forming program and in response to signals from said input elements, said control means including an output latch means having a plurality of parallel bit stores, bit stores of said output latch means being interconnected to respective ones of said actuatable elements to apply operation control signals on said actuatable elements, wherein said output latch means generates latch signals during the time of operation to control the latch operation of said actuatable elements through the output latch.

10. Apparatus in accordance with claim 9, wherein said control means comprises a common register having parallel bit positions associated with said memory means, actuatable elements and input elements.

11. A machine in accordance with claim 10, wherein at least one of said actuatable elements and at least one of said input elements are interconnected to one bit position of said common register.

12. A machine in accordance with claim 10, wherein the bits of said common register are set to start an image formation operation.

13. Apparatus in accordance with claim 9, wherein said latch means includes a plurality of registers each having said parallel bit positions, one of said registers being selected by an address signal thereto to control the latch operation of at least one of said actuatable elements through the selected register.

* * * * *